US009435542B1

(12) United States Patent
Goodson

(10) Patent No.: US 9,435,542 B1
(45) Date of Patent: Sep. 6, 2016

(54) FIREPLACE UNIT WITH INTERNAL SMOKE DIVERSION

(71) Applicant: Thomas B. Goodson, Dallas, TX (US)

(72) Inventor: Thomas B. Goodson, Dallas, TX (US)

( * ) Notice: Subject to any disclaimer, the term of this patent is extended or adjusted under 35 U.S.C. 154(b) by 550 days.

(21) Appl. No.: 13/792,606

(22) Filed: Mar. 11, 2013

Related U.S. Application Data

(63) Continuation-in-part of application No. 13/363,823, filed on Feb. 1, 2012.

(60) Provisional application No. 61/438,489, filed on Feb. 1, 2011, provisional application No. 61/484,056, filed on May 9, 2011.

(51) Int. Cl.
*F24B 1/18* (2006.01)
*F24B 1/189* (2006.01)

(52) U.S. Cl.
CPC ..... *F24B 1/189* (2013.01)

(58) Field of Classification Search
CPC ..... F24B 1/18; F24B 1/198; F24B 7/005
See application file for complete search history.

(56) References Cited

U.S. PATENT DOCUMENTS

| | | | | | |
|---|---|---|---|---|---|
| 220,843 | A | * | 10/1879 | Jackson | 126/500 |
| 2,009,642 | A | * | 7/1935 | Jaquith et al. | 126/531 |
| 2,122,635 | A | * | 7/1938 | Borgstrom | 126/511 |
| 2,154,939 | A | * | 4/1939 | Howe | 126/531 |
| 2,170,729 | A | * | 8/1939 | Walter | 126/513 |
| 2,258,882 | A | * | 10/1941 | Craig | 126/521 |
| 2,347,433 | A | * | 4/1944 | Praeger | 122/356 |
| 2,396,535 | A | * | 3/1946 | Rumery | 126/531 |
| 2,432,038 | A | * | 12/1947 | Maxim | 126/100 |
| 2,494,527 | A | * | 1/1950 | Walters | 126/531 |
| 2,671,440 | A | * | 3/1954 | Dupler | 126/512 |
| 2,821,975 | A | * | 2/1958 | Thulman | 126/500 |
| 3,053,455 | A | * | 9/1962 | Eichenlaub | 126/552 |

(Continued)

FOREIGN PATENT DOCUMENTS

| | | | |
|---|---|---|---|
| DE | 3040626 | A1 * | 5/1982 |
| WO | 2012106435 | A1 | 8/2012 |

OTHER PUBLICATIONS

What is a Rumford Fireplace Anyway?, http://www.rumford.com/articleWhat.html, Jan. 21, 2012, pp. 1-2.

(Continued)

*Primary Examiner* — Jorge Pereiro
(74) *Attorney, Agent, or Firm* — Grady K. Bergen; Griggs Bergen LLP

(57) ABSTRACT

A fireplace unit includes a pair of spaced apart opposite, upright sidewalls. The sidewalls define an interior compartment of the fireplace unit. The sidewalls each have a forward end and rearward end substantially aligned along lines that converge rearwardly. The sidewalls are one of (1) joined directly together at the rearward ends and (2) joined together at the rearward ends by an upright rear wall having a transverse width that is less than ¾ of the transverse width of each of the sidewalls for at least a majority of the rear wall's length. The upper end of each of the sidewall slopes upward from the forward end toward the rearward end. A floor extends between the sidewalls for closing the lower end of the interior compartment. A cover is coupled to the upper ends of the sidewalls for closing the upper end of the interior compartment. A flue is provided for directing smoke and air out of the interior compartment. A smoke diversion body is provided for forming a smoke flow area constriction.

20 Claims, 13 Drawing Sheets

(56) References Cited

U.S. PATENT DOCUMENTS

| | | | | | |
|---|---|---|---|---|---|
| D201,482 | S | * | 6/1965 | Lever | D23/350 |
| D205,569 | S | * | 8/1966 | Winegardner | D23/350 |
| 3,337,715 | A | * | 8/1967 | Finn | A61H 33/063 126/344 |
| 3,421,495 | A | * | 1/1969 | Winegardner | 126/555 |
| 3,538,909 | A | * | 11/1970 | Williams et al. | 126/515 |
| 3,721,225 | A | * | 3/1973 | Tidwell | 126/536 |
| D235,447 | S | * | 6/1975 | Milliman | D23/350 |
| 3,995,611 | A | * | 12/1976 | Nelson | 126/521 |
| 4,129,114 | A | * | 12/1978 | Hiser | F24B 1/1886 126/509 |
| 4,243,177 | A | * | 1/1981 | Powers | 126/509 |
| 4,259,941 | A | | 4/1981 | Gerdes | |
| 4,280,656 | A | * | 7/1981 | Swanson | 237/55 |
| 4,291,670 | A | | 9/1981 | Hyatt | |
| 4,305,374 | A | * | 12/1981 | Taylor | F24B 1/195 126/500 |
| 4,385,622 | A | * | 5/1983 | Tidwell | 126/531 |
| 4,470,399 | A | * | 9/1984 | Pitha | 126/523 |
| 4,478,208 | A | * | 10/1984 | Pitha | 126/500 |
| 4,562,826 | A | * | 1/1986 | Litta | 126/524 |
| 4,844,051 | A | * | 7/1989 | Horkey | F24B 1/006 110/221 |
| 4,897,524 | A | * | 1/1990 | Brasell | 392/348 |
| 5,009,220 | A | | 4/1991 | Cornelison | |
| 5,052,311 | A | * | 10/1991 | Kincaid | F24B 1/181 110/235 |
| 5,598,834 | A | | 2/1997 | Grady | |
| 5,887,388 | A | * | 3/1999 | Hempel et al. | 52/27 |
| 6,024,085 | A | | 2/2000 | Hodge et al. | |
| 6,098,614 | A | | 8/2000 | Fleming | |
| D431,646 | S | * | 10/2000 | Mattarelli | D23/404 |
| 6,178,965 | B1 | | 1/2001 | Sulak | |
| 6,463,926 | B1 | | 10/2002 | Flick et al. | |
| D470,583 | S | | 2/2003 | Klemming | |
| 6,953,037 | B2 | | 10/2005 | Rumens | |
| 7,066,170 | B1 | | 6/2006 | Atemboski et al. | |
| 7,077,122 | B2 | | 7/2006 | Lyons et al. | |
| D559,375 | S | * | 1/2008 | Rumens et al. | D23/403 |
| 8,061,348 | B1 | | 11/2011 | Rodriguez | |
| 2001/0050078 | A1 | | 12/2001 | Moberg | |
| 2004/0200470 | A1 | | 10/2004 | Rumens | |
| 2007/0221204 | A1 | * | 9/2007 | Hussong | F24B 1/18 126/500 |
| 2007/0277808 | A1 | * | 12/2007 | Bean | 126/307 R |
| 2007/0289206 | A1 | * | 12/2007 | Kertz | A01G 15/00 47/1.4 |
| 2008/0184988 | A1 | * | 8/2008 | Mullin | 126/500 |
| 2009/0199788 | A1 | * | 8/2009 | Lesage | 122/155.2 |

OTHER PUBLICATIONS

Classic Flyer Plan—Rumford Fireplace, http://www.rumford.com/classicflyerplan.html, Jan. 21, 2012, p. 1.

International Search Report in International PCT Application No. PCT/US2012/023493, May 12, 2012, pp. 1-11.

International Preliminary Report on Patentability in International PCT Application No. PCT/US2012/023493, Aug. 15, 2013, pp. 1-7.

* cited by examiner

FIREPLACE UNIT WITH INTERNAL SMOKE DIVERSION

CROSS-REFERENCE TO RELATED APPLICATIONS

This application is a continuation-in-part of U.S. application Ser. No. 13/363,823, filed Feb. 1, 2012, which claims the benefit of U.S. Provisional Application Nos. 61/438,489, filed Feb. 1, 2011, and 61/484,056, filed May 9, 2011, each of which is incorporated herein by reference in its entirety for all purposes.

BACKGROUND

Many fireplaces are notorious for not drawing well, and leak smoke into the room. To combat a poorly drawing fireplace of a conventional design, one necessarily must locate the fire at the back of a deep, usually rectangular-shaped firebox, thereby limiting the heat throw, and making setting, lighting, tending and maintaining the fire within more difficult. Outdoor wood burning fire pits have no method of channeling smoke, so depending on wind conditions, those near such fire pits may be subjected to blowing smoke. Fixed outdoor wood burning fireplaces are also susceptible to wind direction and wind interference, as well as those problems mentioned above, including poor draw and deep fireboxes that are difficult to set, light, tend and maintain, and that do not throw heat well.

The present invention is directed toward addressing those shortcomings of the prior fireplace designs.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
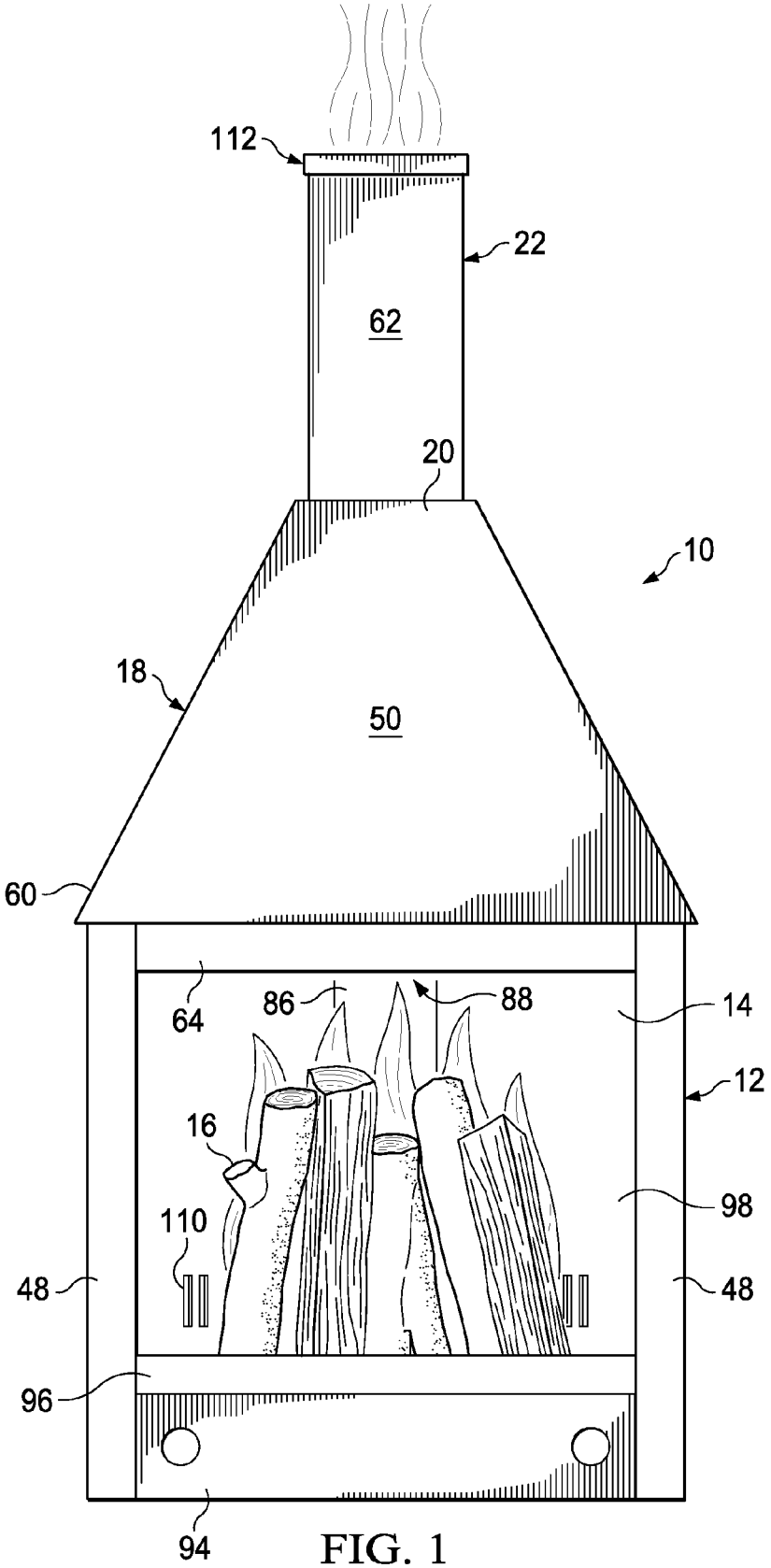
FIG. 1 is a front elevational view of a fireplace unit constructed in accordance with the invention.

Referring to FIG. 1, a fireplace unit 10 is shown. The fireplace unit 10 is shown as a free-standing fireplace unit for indoor or outdoor use, although in other embodiments it may be incorporated or built into a dwelling, building or other structure, both indoor and outdoor. The fireplace unit 10, as well as others described herein, may be self-contained, without requiring coupling, connection or incorporation of other equipment, structures or ductwork for proper functioning. Generally, the fireplace unit 10 includes a firebox 12 having an interior compartment 14 where combustible fuel 16, such as wood (logs), charcoal, natural gas, propane, etc., may be burned within the interior compartment 14. A throat 18 is located directly above the firebox 12 to form a smoke chamber above the firebox 12 in communication with the interior compartment 14 of the firebox 12 and funnels smoke and gases from the burning fuel 16 to a constricted upper throat portion 20 where smoke and gases are discharged from the fireplace unit 10 through a flue 22.

It should be noted at the outset that certain terms and expressions used with respect to fireplace design and construction, such as "throat," "smoke chamber," "hearth," etc., do not necessarily have standardized definitions and may therefore be used differently in the relevant art to describe or refer to different structures or features of the various fireplace designs. Such terms and expressions as used herein with respect to the embodiments shown and described, however, have been used consistently and are meant to refer to those features as they are described in conjunction with the figures but may not necessarily correspond to those similarly named structures or features in the relevant art due to the generalized nature and inconsistent usage of such terms.

Figure 2:
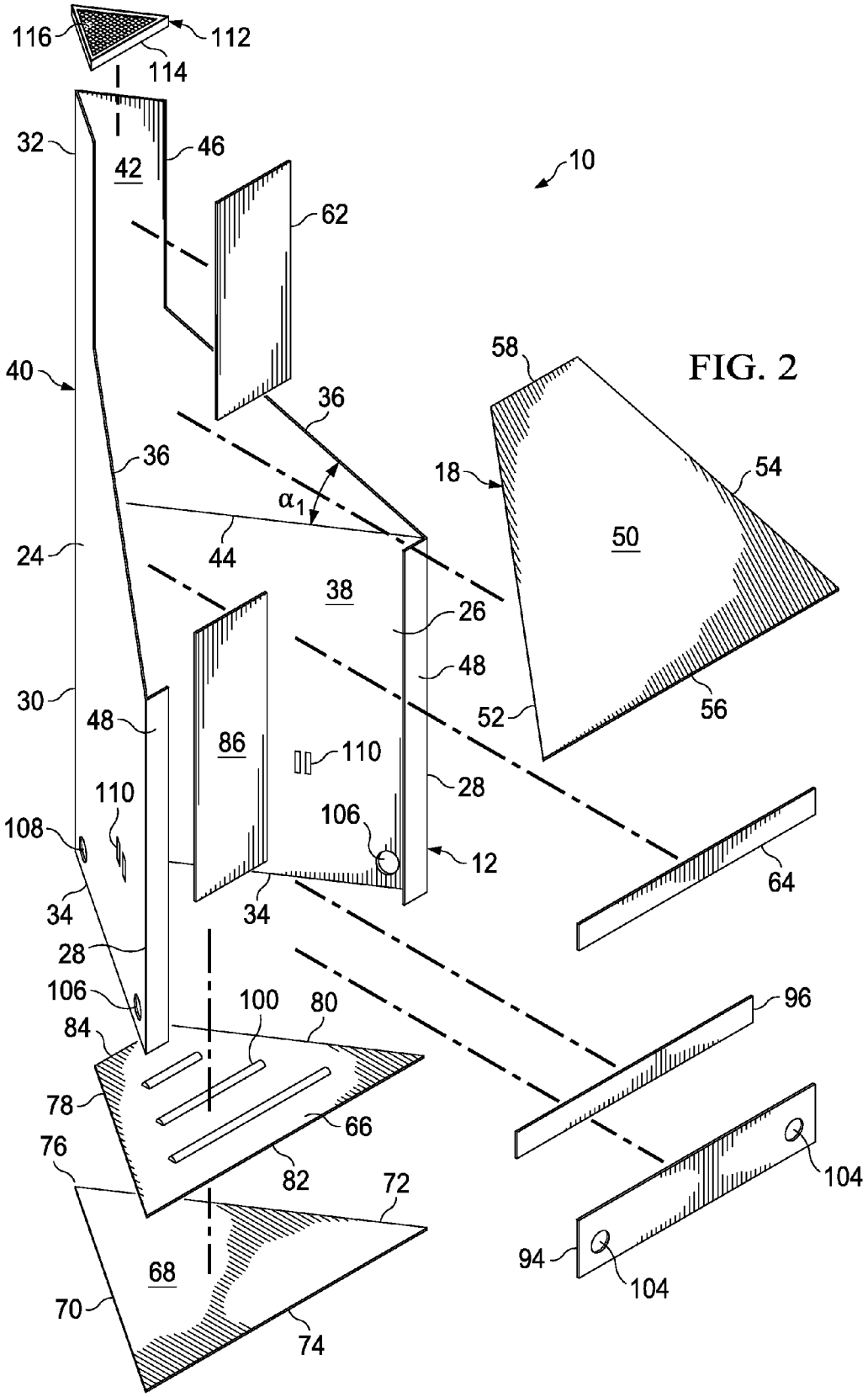
FIG. 2 is a front, exploded perspective view of the fireplace unit of FIG. 1.
Figure 3:
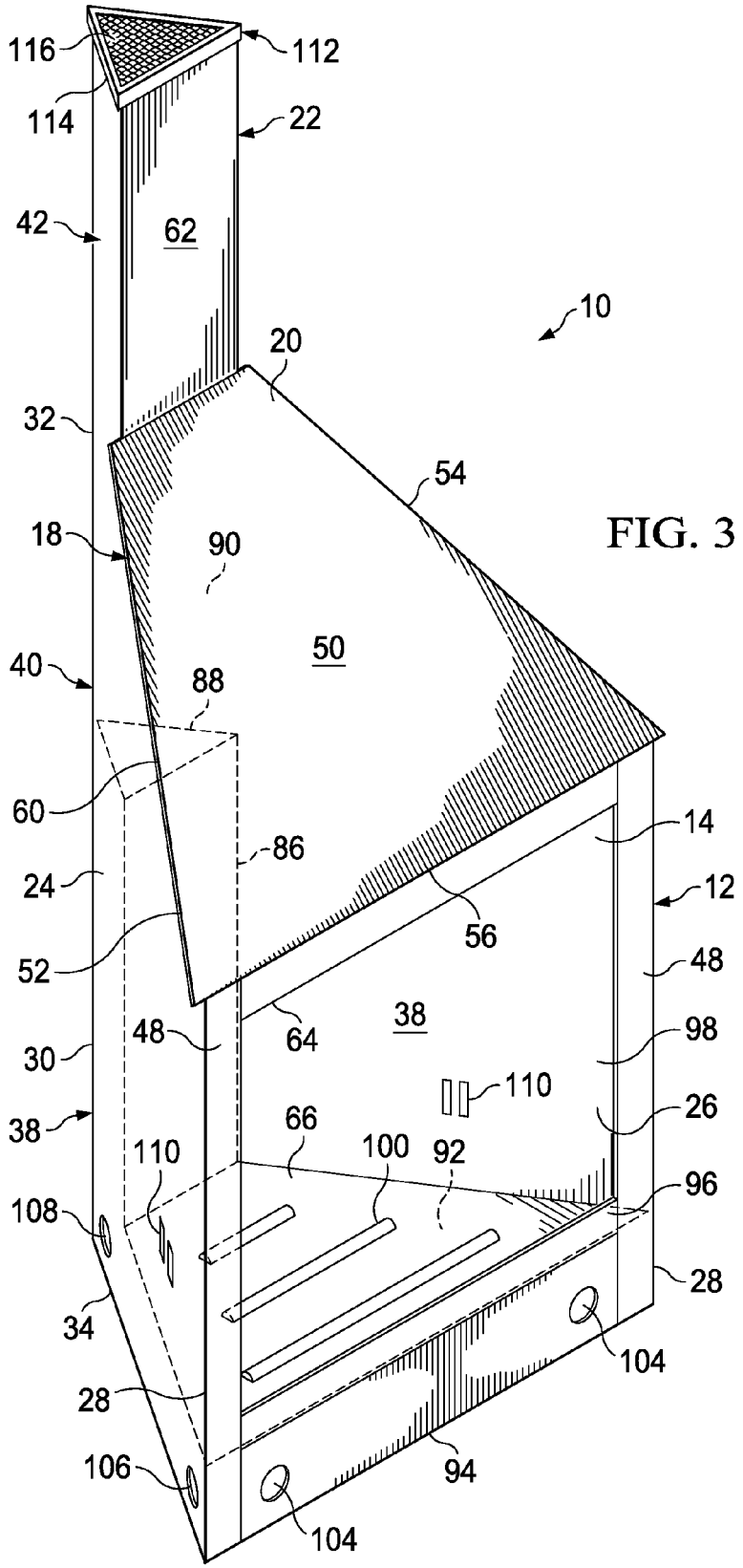
FIG. 3 is a front perspective view of the fireplace unit of FIG. 1.
Figure 4:
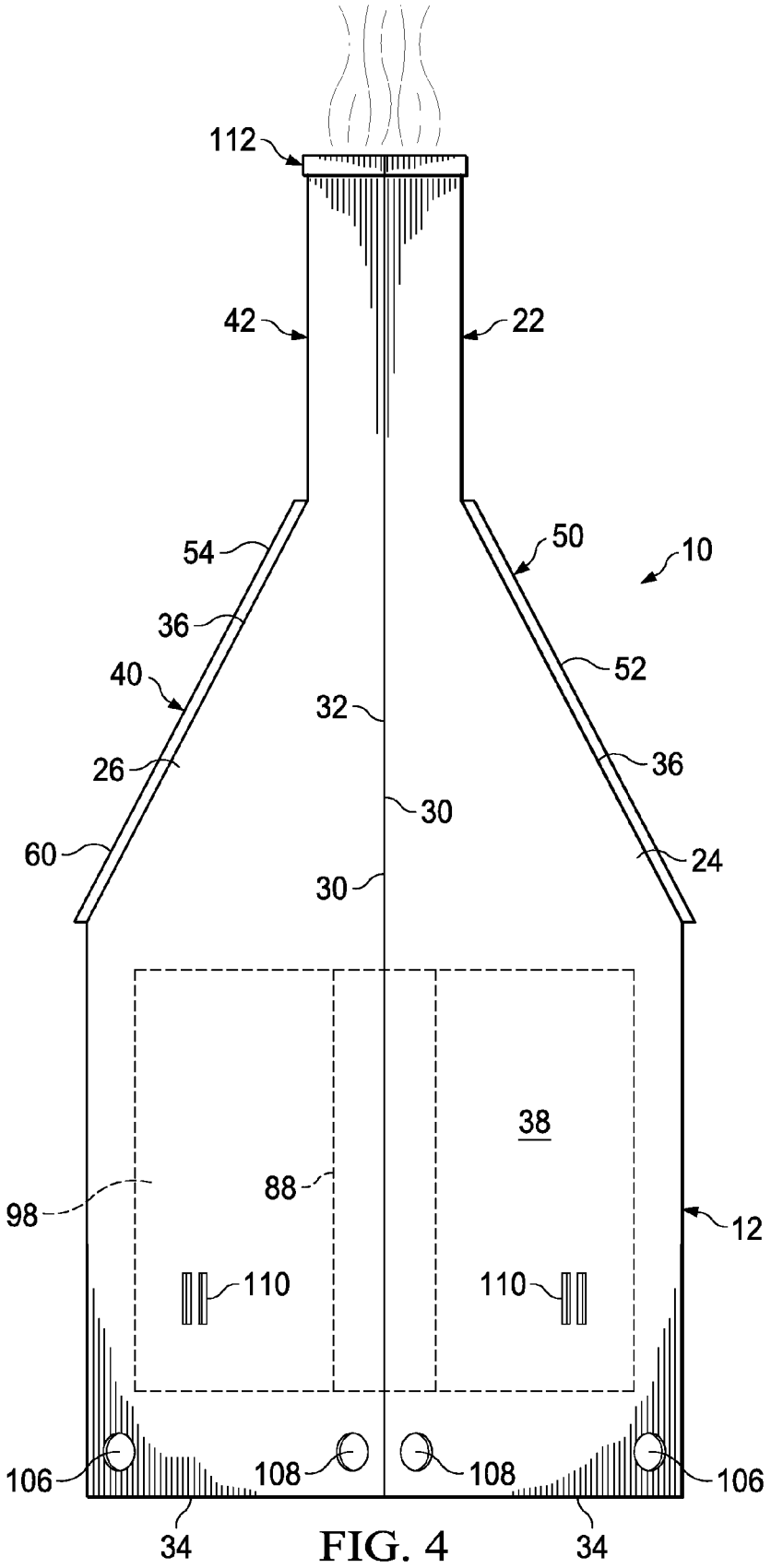
FIG. 4 is a rear plan view of the fireplace unit of FIG. 1.

FIG. 2 shows an exploded view of the fireplace unit 10 to illustrate its various components. While the following description applies to the fireplace unit 10 and its components, as shown in FIGS. 1-4, it may also have application to the other embodiments of fireplace units that are shown and described herein, as will be apparent to those skilled in the art. The fireplace unit 10 is composed of two opposite, upright sidewall members 24, 26. In the embodiment shown, the sidewall members 24, 26 are formed from planar or substantially planar members that are oriented or angled about a vertical or upright axis so that the sidewall members 24, 26 converge from their forward ends 28 toward their rearward ends 30 (FIG. 4), where they are joined directly together at an upright or vertical vertex 32 so that the converging sidewall members 24, 26 have a generally triangular transverse or horizontal cross-sectional configuration along their heights or lengths. In the embodiment shown, the sidewall members 24, 26 are formed from a single piece of material that is bent or angled along the vertex 32. In other embodiments, however, the sidewall members 24, 26 may each be formed separately in one or more portions and be coupled together along the vertex 32 by suitable coupling mechanisms.

The lower ends 34 of the sidewall members 24, 26 may be generally flat and lie in a horizontal plane for resting on a flat, horizontal or level support surface. In other embodiments, however, the lower ends 34 may be configured differently to cooperate with different non-level or non-horizontal support surfaces or structures.

The sidewall members 24, 26 extend upward from the lower ends 34 to define a lower firebox portion 38, an intermediate smoke chamber portion 40 and an upper flue portion 42. The firebox portion 38 of the sidewall members 24, 26 corresponds to the firebox 12 and may be generally defined as that area of the sidewalls 24, 26 generally located below a horizontal or transverse line 44 extending rearward from the top or upper portion of the forward end 28 of the sidewall members 24, 26 with the unit 10 resting in a level upright position, as it would be during normal use.

As is shown in FIG. 2, the upper end or edge 36 of each sidewall member 24, 26 is straight or substantially straight and slopes upward from the forward end 28 towards the rearward end 30 to the flue portion 42, where the sloped portion of the upper ends 36 terminates forward a distance (e.g. 2 to 12 inches) from the vertex 32 at the upper throat portion 20 so that the sloped upper ends 36 of the sidewalls 24, 26 are arranged in configuration resembling an isosceles trapezoid. The angle $\alpha_1$ of slope of the upper ends 36 relative to the line 44 may vary anywhere from about 1° to about 89°, more particularly form about 10°, 15°, 20°, 25°, or 30° to about 60°, 65°, 70°, 75, or 80°. More typically, the angle $\alpha_1$ will range from about 30° to about 60°, with from about 35° to about 55° being used in certain instances. In cases where the sloped upper end 36 of the sidewall members are not necessarily straight, the angle $\alpha_1$ may be measured relative to the line 44 and a line extending between the forward-most and rearward-most point of the sloped upper end 36 of the sidewall members 24, 26.

It should be noted in the description, if a numerical value or range is presented, each numerical value should be read once as modified by the term "about" (unless already expressly so modified), and then read again as not so modified unless otherwise indicated in context. Also, in the description, it should be understood that an amount range listed or described as being useful, suitable, or the like, is intended that any and every value within the range, including the end points, is to be considered as having been stated. For example, "a range of from 1 to 10" is to be read as indicating each and every possible number along the continuum between about 1 and about 10. Thus, even if specific points within the range, or even no point within the range, are explicitly identified or refer to, it is to be understood that the inventor appreciates and understands that any and all points within the range are to be considered to have been specified, and that inventor possesses the entire range and all points within the range.

The flue portion 42 of the sidewall members 24, 26 corresponds to the flue 22 and extends upward and forward from the vertex 32 to the sloped upper ends 36, terminating at forward edges or ends 46. The smoke chamber portion 40 of the sidewalls 24, 26 may be generally defined as the area located above the line 44 and below flue portion 42 and defines a smoke chamber of the unit 10. The forward edges 46 of the flue portion 42 of the sidewalls 24 26 are shown as being straight and vertical or substantially vertical. In other embodiments, the forward edges 46 may be angled from the vertical at the same or a different angle than the angle $\alpha_1$ relative to the line 44. If at a different angle, the forward edges may be at an angle that is greater or closer to vertical (i.e. 90°) than the angle $\alpha_1$.

The flue portion 42 may extend upward from several inches to several feet above the smoke chamber portion 40. In a conventional size, free-standing embodiment for use in residential outdoor environments where the flue 22 discharges into the open air, the flue portion 42 may extend from several inches to about 4 or 5 feet, more particularly from 1 to 3 feet above the smoke chamber portion 40. The height of the flue portion 42 may vary, however, depending upon the elevation and height of the fireplace unit 10 during its use and the environment it is used. In some outdoor applications, a flue having a discharge at 7 feet or 8 feet or more above the ground or other support surface so that smoke and gases are discharged at a position above most peoples' heads when they are standing nearby may be desirable. In other applications and embodiments, the flue may have other configurations and discharge heights. The flue may discharge into or be in communication with a separate chimney or other ductwork.

Vertical, opposite face frame side members 48 may be coupled to the forward ends 28 of the firebox portion 38 of the sidewalls 24, 26. These may be separate members that are coupled to the forward ends 28 by suitable coupling mechanisms. Alternatively, the frame members 48 may be formed by bent or angled portions of the materials forming the sidewalls 24, 26 that are bent or angled inward toward one another, as is shown. In other embodiments, the frame members 48 may be absent.

A throat cover 50 is provided with the fireplace unit 10. The throat cover 50 is shown as planar member configured as an isosceles trapezoid with opposite side edges 52, 54 that converge toward one another from a wider forward end edge 56 to a parallel, narrower rearward end edge 58 of the throat cover 50. The trapezoidal shape of the throat cover 50 is configured to generally correspond and coextend with the sloped upper ends 36 of the sidewalls 24, 26 to cover and close the open area or smoke chamber between the sidewalls 24, 26. In certain instances, the throat cover 50 may be configured so that the side edges 52, 54 and/or forward end 56 may extend outward a distance beyond the sidewalls 24, 26 to form an overhanging lip or edge 60. In other instances, the side edges 52, 54 and/or forward end 56 of the throat cover 50 may be substantially flush with the exterior of the sidewalls 24, 26.

A front flue wall 62, which may be configured as a planar member, is coupled to the sidewalls 24, 26 of the flue portion 42 along the forward edges 46 to close off the forward opening between flue portion 42 of the sidewalls 24, 26. The flue wall 62 extends upward from the rearward edge 58 of the throat cover 50 and coextends upward with the sidewalls 24, 26.

In certain embodiments, a face frame header piece 64, which may be configured as a rectangular planar member, may be provided that extends between the forward ends of the sidewalls 24, 26 and/or frame members 48 directly beneath the throat cover 50.

In the embodiment shown in FIGS. 1-4, the floor of the fireplace unit 10 at its base is composed of a firebox floor 66 and subfloor 68. The subfloor 68 is configured as a triangular planar member having opposite side edges 70, 72 that converge from a forward edge 74 to a vertex 76. The subfloor 68 has a perimeter that is similar and shape to the lower perimeter of the sidewalls 24, 26 and substantially coextends with and couples along its perimeter to the lower ends 34 of the sidewalls 24, 26 to close off the lower open area between the sidewalls 24, 26.

The firebox floor 66 is formed as a planar member configured generally as an isosceles trapezoid having opposite side edges 78, 80 that converge rearwardly toward one another between parallel forward and rearward end edges 82, 84. The trapezoidal shape of the firebox floor 66 corresponds to the forward interior space located between the sidewalls 24, 26. The firebox floor 66 is spaced above the subfloor 68 a distance and locates between the sidewalls 24, 26 of the firebox portion 38. In conventional size fireplace units, the distance between the floor 66 and subfloor 68 may vary from 1 inch or less to several inches. In many embodiments, the distance will range from about 1 inch to 3 or 4 inches. The floor 66 and/or subfloor 68 may be generally level or oriented in a horizontal plane. In other embodiments, the floor 66 and/or subfloor may be slightly inclined, such as being inclined upwards in either the forward or rearward directions.

The rearward edge 84 of the firebox floor 66 terminates forward of the vertex 32 to form a gap therebetween and to cooperate with an interior rear wall 86 that may be formed as a planar member or non-planar member. The interior rear wall 86 is oriented substantially vertically and spaced forward of the vertex 32, as well. The rear wall 86 extends transversely between the interior the sidewalls 24, 26 and defines an air conduit or "air tunnel" 88 (FIG. 3) that extends upward between the vertex 32 and the rear edge 84 of the firebox floor 66. The rear wall 86 may extend for a distance and terminate slightly below, at or above the firebox line 44 so that air from the air conduit 88 may flow upwardly and be discharged generally into the smoke chamber 40 but be spaced from the flue portion 42 to form a gap or space 90 (FIG. 3) below the flue 22 or lower end of the flue wall 62. The rear interior wall 86 may be substantially parallel to the flue wall 62 and be coincidental or non-coincidental with the flue wall 62. In most instances, the air conduit 88 will be aligned with the flue portion so that air flows directly upward from the air conduit 88 towards the flue 22.

In other embodiments, the rear wall 86 may extend beyond the smoke chamber 40 and into the flue 22, as much as half way or more, to facilitate drawing of air into the flue 22. In such cases, the rear wall 86 may be spaced rearward of the flue wall 62 so the flue has sufficient space to facilitate drawing of air into the flue 22 from the interior compartment 14 and smoke chamber, or a separate conduit that forms a continuing portion of the air tunnel having smaller dimensions than the flue 22 so that it may be received and extend into the flue 22 while providing sufficient airflow space within the flue 22 surrounding such inner conduit. In certain embodiments, the interior wall 86 may be non-vertical and may be inclined rearward from the lower end so that area of the conduit 88 constricts along its height or length toward its upper end. This may further increase the velocity of air due to the constricted space as it is discharged from the conduit 88. In such cases, the rear wall 86 would be configured to accommodate such an orientation, such as a narrowed or tapered width.

The lower inlet of the air conduit 88 communicates with an air chamber or space 92 located below the firebox floor 66 and above the subfloor 68. A lower front panel 94, which may be a planar member, is provided that extends between the forward ends 28 of the sidewalls 24, 26 and/or the opposite frame members 48 and closes the forward space between the firebox floor 66 and subfloor 68. The front panel 94 may also be configured to extend or project upward a distance (e.g. ½ to 2 or 3 inches) above the forward edge 82 of the firebox floor 66 to provide a forward lip or flange 96 (FIG. 3) to provide a barrier to retain hot coals or ashes within the interior compartment 14 of the fireplace unit 10. In certain embodiments, the lip or flange 96 may be a separate member and may be hinged, movable or removable to facilitate sweeping and cleaning of ashes and materials from the interior and the firebox floor 66.

The frame members 48, header 64 and lower front panel 94 or lip 96 together constitute a frame face that frames the opening 98 of the fireplace unit 10 that leads into the interior compartment 14.

Raised ribs, ridges or other structures or projections 100 may be provided on the firebox floor 66 to facilitate retaining wood, coals, embers, etc. rearwardly within the interior compartment. In the embodiment shown the structures 100 are in the form of several transverse ridges that are spaced apart along the length of the floor 66. The ridges may extend across all or a portion of the width of the firebox floor 66.

The area between the firebox floor 66 and subfloor 68 defines the space or chamber 92. Various vents or openings 104, 106, 108 may be provided in the front panel 94 and/or sidewalls 24, 26 in the areas overlaying the chamber 92 and communicate with the chamber 92. These vents allow air to flow from the exterior of the fireplace unit 10 into the chamber 92 and to the air conduit 88. These vents may be located at various positions. In certain embodiments, vents near the rear or adjacent to the conduit 88, such as the vents 108, may be eliminated so that air is drawn from the front of the unit 10, such as through the forwardly located vents 104, 106. This causes air to accelerate as it flows to the inlet of the air conduit 88 as it is constricted by the narrowing of the air chamber 92 near the lower air conduit inlet. Because the vents 104, 106, 108 do not communicate directly with the interior compartment 14, ashes, coals or embers cannot pass through theses vents.

In other embodiments, vents 110 may be formed in the sidewalls 24, 26 forward of the air conduit 88 and above firebox floor 66 to communicate with and provide airflow directly into the interior compartment 14. In certain embodiments, such vents 110 may be located toward or at the rear of the interior compartment 14 and near the firebox floor 66 so that air is provided most directly and effectively to the fuel and embers resting at the rear of the interior compartment 14. The converging sidewalls 24, 26 facilitate such location of the vents 110 toward the rear and immediately adjacent to the combusting fuel within the interior compartment 14 that differs from conventional fireplace designs. The sidewall vents 110 or portions thereof may be located at a position towards the rear of the sidewalls 24, 26 in an area extending forward from any rear interior wall or vertex from 50%, 45%, 40%, 35%, 30%, 25%, 20%, 15%, 10%, 5% or less of the sidewall's width. The vents 110 or portions thereof may also be towards the lower ends of the sidewalls extending upward from the firebox floor. The vents 110 or portions thereof may be located at the level of the firebox floor or the lower 50%, 45%, 40%, 35%, 30%, 25%, 20%, 15%, 10%, 5% or less of the sidewall's height or length above the firebox floor within the interior compartment 14. In many cases for conventional size fireplace units, depending upon the configuration of the fireplace unit, the vents 110 or a portion thereof may be located at or from less than 1 inch to 1, 2, 3, 4, 5, 6, 7, 8, 9, 10, 11, or 12 inches from a centerline bisecting the converging sidewalls 24, 26. In certain embodiments, the vents 110 or a portion thereof may also be located at the level of the firebox floor or be located from less than 1 inch to 1, 2, 3, 4, 5, 6, 7, 8, 9, 10, 11, or 12 inches from the firebox floor. The vents 110 or a portion thereof may also be located at any rear interior wall or vertex (if no rear wall) or be located from less than 1 inch to 1, 2, 3, 4, 5, 6, 7, 8, 9, 10, 11, or 12 inches from any rear interior wall or vertex. In certain cases, vents may also be provided in the rear wall itself, particularly where rear wall constitutes an exterior rear wall, as with respect to other embodiments described later on.

In some embodiments, the subfloor 68 may be eliminated with the lower ends 34 of the sidewalls 24, 26 resting directly on the ground, floor or other support surface. In such cases, the ground, floor or other support surface serves as the subfloor 68, with the chamber 92 being formed by the area between such support surface and the firebox floor 66.

A spark arrester 112 may also be provided with the unit 10. The spark arrester 112 may be configured with a frame 114 that is sized and configured to fit over the top of the flue 22. The spark arrester 112 may include a wire screen or mesh 116 or other air permeable material that extends across the frame 114 to facilitate rising sparks, embers and ashes from being discharged from the flue 22. The spark arrester 112 may be removable or be permanently mounted to the flue 22. Similarly, while the upper discharge end of the inner conduit 88 may be located at a height above any combustible materials such that materials would unlikely enter the conduit 88, the conduit 88 may also be provided with an air permeable cover (not shown), such as a wire screen or mesh, to prevent any coals, embers or other materials from entering and passing downward through the conduit 88.

The various components of the unit 10 may be movable and/or removable. For instance, the throat cover 50 may be removable or pivotally mounted to the sidewalls 24, 26 to provide an additional access to the interior compartment 14 such as for cleaning or maintenance purposes. The interior rear wall 86 and/or flue wall 62 may be fixed, movable or removable for cleaning or maintenance purposes. The front panel 94 may be fixed, but may also be movable or removable to provide a door for accessing the chamber 92 below the floor 66 and/or to facilitate sweeping, maintenance or removing coals and ashes resting on the firebox floor 66. Various doors or other access points (not shown) may be provided in the sidewalls 24, 26 or other components of the unit at various positions to provide access to the interior of the unit for cleaning, maintenance or other purposes.

The components of the fireplace unit 10, as well as other fireplace units described herein, may be formed from a variety of different materials. These may include non-combustible and heat resistant metal and non-metal materials. Metal materials may include iron, steel, extruded steel, steel alloys, aluminum, extruded aluminum, cast aluminum, aluminum alloys, brass, brass alloys, copper, copper alloys, zinc, zinc alloys, etc. Non-combustible, non-metal materials may include concrete, synthetic concrete, clay, synthetic clay, brick, stone, mortar, ceramics, artificial stone, glass, tempered glass, fiberglass, composite materials, etc. Glass or other materials may be transparent or translucent, to allow the interior 14 to be viewed so that the fire and flames are visible through such materials. Combustible materials, such as wood or plastic may also be used provided they are treated or rendered non-combustible and heat resistant by being impregnated, coated or otherwise treated with materials that may impart such properties. These may include treatment materials that are presently available or that may be later developed, such as ceramic paints or coatings. Combinations of the above-described materials may also be used for all or portions of the various components.

The materials forming the fireplace unit 10, in particular the materials forming the main components, such as the sidewalls 24, 26, throat cover 50, floors 66, 68, flue 22, etc. may have a thermal conductivity (k) of 10 W/m·° C. or more at 25° C. to facilitate heat transfer from the fireplace unit 10. Additionally, the interior surfaces of the sidewalls 25, 26 and other components may be polished, mirrored, coated, laminated or otherwise be provided with a shiny or reflective surface to facilitate reflecting or radiating heat and/or light. The interior surfaces may also be formed or lined with refractory materials, brick, stone, etc.

In certain embodiments, the fireplace unit 10 is formed from metal materials, such as iron, steel, or aluminum. In particular, the sidewalls 24, 26, throat cover 50, flue 22 and other major components may be formed from such materials. Such materials may be plate materials having a thickness of from about 1/16 inch to about 1 inch or more, more particularly from about 1/8 inch to about 3/4 inch. Glass and other non-metal materials may also have a similar thickness. In other embodiments, where brick, stone or other non-plate-like materials are used, these thicknesses may be greater.

Various components of the unit 10 may be provided with design elements, such as embossing, anodizing, etching. Raised or recessed designs or indicia may be provided on the components and may be coupled thereto or formed with the components, such as by casting, molding, etching or the like. These may be provided on exterior or interior surfaces.

The fireplace unit and unit components or portions thereof may be colored with the same or different colors, such as by painting, coating or otherwise incorporating a coloring agent. Such coloring agents may be heat resistant and rated to perform under high heat conditions, including but not limited to petroleum-based paints and/or solvents, powder coating agents or other materials that may be commercially available now or in the future.

Fixed, movable, or pivotable coupling mechanisms and fasteners may be used to couple the various components of the unit together. These may include welds, brackets, screws, rivets, hinges, friction fit, latches, magnets, cement, mortar, glue, etc. Various components may be cast, molded, shaped or otherwise formed together as integral pieces.

In certain embodiments, the unit 10 may be constructed as a free-standing unit, which may be portable or non-portable and that is manufactured out of steel, iron or aluminum, which may be extruded or otherwise formed into the various components and elements and welded or fastened together.

The rear wall 86 and/or sidewalls 24, 26 near the rear of the interior compartment 14 may be provided with notches, fingers, or other members or elements (not shown) that project from their interior surfaces to facilitate holding logs or other fuel sources in place.

Figure 5:
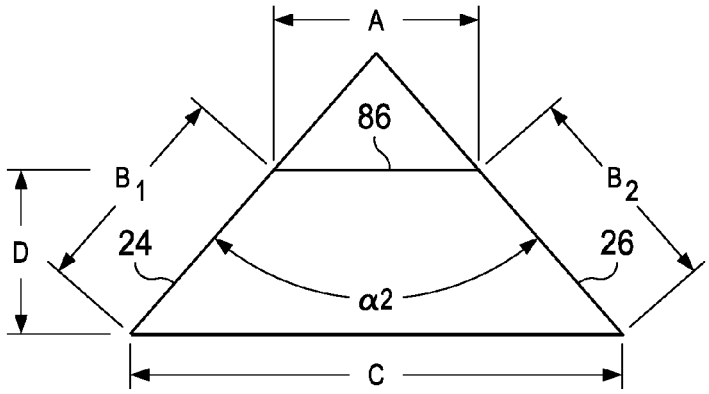
FIG. 5 is a top cross-sectional plan view of a schematic of a fireplace unit, shown with the various relative dimensions and spatial relationships designated.

Of particular relevance to the fireplace unit 10, and those units described herein, is the relationship of the sidewalls and any rear wall forming the firebox interior. FIG. 5 shows a schematic cross-sectional plan view of a fireplace unit showing the converging sidewalls 24, 26 and the rear interior wall 86 of the firebox 12. As is shown, the rear wall 86 has a width A, with the sidewalls 24, 26 each having a width $B_1$, $B_2$ extending forward of the rear wall 86. In embodiments where the walls are not linear the width would constitute the linear horizontal or transverse distance between the ends of the walls along any given point along the wall's height. The rear wall has a transverse width A that is less than the transverse width $B_1$ or $B_2$ of the sidewalls. More particularly the transverse width of the rear wall and sidewalls along any given point along the length or height of the sidewalls and rear wall may have the relationship wherein $A<0.75\times B$; $A\leq 0.7\times B$; $A\leq 0.65\times B$; $A\leq 0.6\times B$; $A\leq 0.55\times B$; $A\leq 0.5\times B$; $A\leq 0.45\times B$; $A\leq 0.4\times B$; $0.35\times B$;

A≤0.3×B; or A≤0.25×B, A≤0.2×B; 0.15×B; A≤0.1×B; or A≤0.05×B where B is the width $B_1$ and/or $B_2$ of the sidewalls. In cases where the converging sidewalls are directly joined together at their rearward ends to form a vertex without a rear wall or rear interior wall A=0 and the width of the sidewalls $B_1$, $B_2$ would be the entire width of the sidewalls from the forward end to the rearward end where they are directly joined together. The relationships of the narrower width of A relative to B exist for all or a majority portion of the rear wall's length or height. Where a majority portion of the of the rear wall's length or height has such a relationship of A being less than B, as specified above, it may include from more than 50% to less than 100% of the rear wall's length or height, more particularly from about 55%, 60%, 65%, 70%, 75%, 80%, 85%, 90%, or 95% to less than 100% of the rear wall's length or height. In certain embodiments, where less than all the rear wall has such a narrower width A relative to the width B of the sidewalls, it may be provided on the lower portion near the firebox floor.

The forward face or front of the fireplace unit as defined by the area between the forward ends of the sidewalls has a transverse width represented by C in FIG. 5. The relationship of C relative to the sidewalls may have the relationship C≥B, C≥2×B; C≥3×B; C≥4×B; or C≥5×B, where B is the width $B_1$ and/or $B_2$ of the sidewalls. In certain cases, C may be slightly less than B. In such cases the relationship 0.8×C≥B may be true.

The depth D of the interior compartment relative to the face width C as measured from the forward face, as defined by the forward ends 28 of the spaced apart sidewalls 24, 26, to the rear wall or vertex of the fireplace unit 10 may range from about 1.2×C to about 0.15×C, more particularly from about 0.9×C to about 0.13×C, from about 0.7×C to about 0.18×C, from about 0.6×C to about 0.2×C, or from about 0.5×C to about 0.25×C.

The design of the fireplace unit 10 allows the vertical height of the fireplace opening to be greater than in conventional fireplaces. The height of the fireplace opening may vary, but in certain embodiments the height of the fireplace opening relative to the width C may range from 0.5×C to 1.5×C.

FIG. 5 further illustrates the angle $\alpha_2$ between the sidewalls 24, 26 measured about the vertex. The angle $\alpha_2$ may range from about 45° to about 160°, more particularly from about 60° to about 150°. In certain embodiments the angle $\alpha_2$ may range from about 70° to about 140°, from about 80° to about 130°, or from about 90° to about 120°. In embodiments where the walls are non-linear the width would constitute the linear horizontal or transverse distance between the ends of the sidewalls along any given point along the wall's height.

The size of the fireplace unit 10 and others described herein may vary. The fireplace face dimension C, with all other dimensions being proportional, may range from 1 inch to as large as 8 feet or more. For the smaller non-conventional-size fireplaces, these may be table-top embodiments, such as for burning of incense or candles. The larger sizes may be used in residential, commercial or industrial applications. In many applications for conventional size units, the fireplace face dimension C may range from about 2 feet to about 4 or 5 feet.

Referring to FIG. 1, in use of the unit 10, and other units described herein, logs or other fuel sources 16 are positioned within the interior compartment 14 near or against the rear wall 86 or vertex, if no interior rear wall is employed. Because the fireplace face and fireplace interior may be much higher than in conventional fireplaces, the logs 16 may be oriented in substantially vertical or upright position within the interior 14. This allows non-standard or longer logs to be used. This also facilitates greater ease of lighting and negates the need for grates or andirons, as used with conventional fireplace designs. With such upright orientation, the individual logs burn more evenly as the flames tend to rise along the length of the logs. More efficient and hotter burning provided by the unit allows greener wood to be burned. As the logs burn, they collapse and form a more compact bed of coals or embers, making tending the fire easier and concentrating the coals or embers for greater heat concentration. Less fuel is required to maintain a given heat output. Adding subsequent logs is also easier and more efficient because each added log is propped up vertically at the back of the interior compartment, directly in contact with the existing bed of coals or embers.

The configuration of the fireplace unit also contributes to more efficient draw and burning of fuel within the fireplace interior. The angled throat 18 formed by the throat cover 50, which forms the smoke chamber 40, converges smoothly to the upper throat 20 and the flue 22 and facilitates drawing of air without any non-movable projecting structures, sharp angles or smoke shelves positioned therebetween that impedes or restricts air flow from the smoke chamber to the lower opening of the flue 22.

The interior conduit or air tunnel 88 also contributes to more efficient draw. As heat builds against the interior wall 86 and within the chamber 92 below the floor 66, the air vents 104, 106, 108 feed ambient air into the inner conduit 88. As the heated air rises through the conduit 88, it encounters air and smoke being emitted into the gap or opening 90 from the interior compartment 14. This creates an increased draw effect as air and gases are accelerated directly upward toward the upper throat 20 and flue 22. The vents 110 located in the sidewalls 24, 26 also facilitate combustion, particularly when they are located near the rear of the interior compartment 14 where the fuel source is positioned. The close proximity of the sidewalls 24, 26 to the combusting fuel allows a much more efficient introduction of ambient air from the vents 110 than with conventional fireplaces.

The fireplace unit 10 may also be fitted with burners or other fixtures to burn non-solid fuel. This may include a burner assembly (not shown) that may be coupled to a source of a combustible gas (e.g. natural gas, propane, butane, etc.) or other fuel (e.g. denatured alcohol). The vents 110 or other openings in the sidewalls 24, 26 or floors 66, 68, may be used to accommodate conduits or fittings for the introduction of such gas or fuel from an exterior location. A dedicated valve or coupling may also be provided for such purposes.

With non-solid fuel sources, non-combustible materials, such as gas logs, gas balls, crushed glass, mineral wool embers, etc. may be positioned within the interior 14 to enhance the fire or flames.

With any fuel source the angled sidewalls allowing for a shallower interior compartment creates more heat transfer into the room or surrounding area. This potentially reduces fuel use while maintaining a desired temperature.

Where metal or thermally conductive materials are used for the fireplace unit, the heat may radiate in all directions (360°) from the fireplace unit.

In some embodiments a grill, cooking surface, hook, clamp, support structure, coupling structure or mechanism, etc. (not shown), which may be removable or non-removable from the unit, may be provided for supporting or suspending food, food or liquid cooking or heating containers for heating or cooking foods or liquids within the interior compartment or other areas of the unit.

As previously discussed, the fireplace unit may be used in outdoor and indoor environments. It may be free standing and portable. In indoor applications, the design allows for less material to be used so construction costs may be lower than with conventional fireplaces. Because of the angled sidewall configuration, in indoor applications the fireplace unit 10 is particularly suited for use in corner locations, as well as in flat wall and multiple shared-wall environments, and is well suited for shared common chimney enclosures both in-wall, in attic and exterior.

Figure 6:
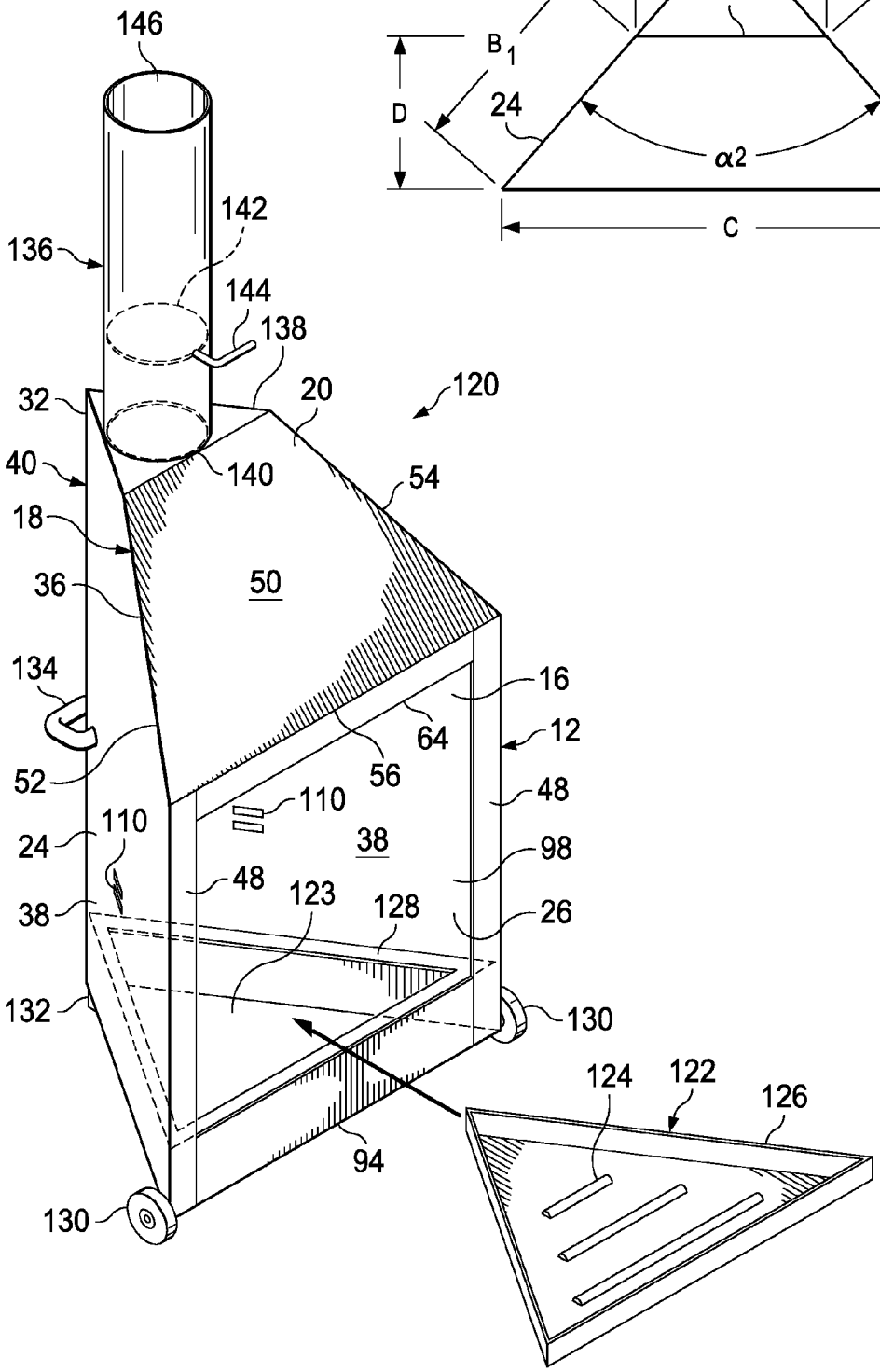
FIG. 6 is a front perspective view of another embodiment of a fireplace unit, shown mounted on wheels and with a removable floor insert of the fireplace unit exploded away, and constructed in accordance with the invention.

Referring to FIG. 6, another embodiment of a fireplace unit 120 is shown. The fireplace unit 120 is similar to the fireplace unit 10, with similar components labeled with the same reference numerals. In the fireplace unit 120, there is no interior rear wall that forms an inner conduit or air tunnel. There is also no vented lower chamber, such as the chamber 92 previously described. The back or rear of the interior compartment 14 is simply formed by the converging sidewalls 24, 26, which converge into a linear upright or vertical vertex.

A removable firebox floor insert or tray 122 is provided with the unit 120. The floor insert 122 is similar to the firebox floor 66 having ridges or projections 124, similar to the ridges 100. The floor insert 122 is sized and configured as a triangle to correspond to the triangular interior shape of the interior compartment 14. The floor insert 122 serves as the firebox floor of the unit 120.

An upward projecting lip or rim 126 is provided along the periphery of the insert 122. The lip 126 may project from ½ to 1, 2 or 3 inches above the floor surface of the insert 122. The lip 126 facilitates retaining of coals, ashes, embers, etc. on the insert 122 during its use and removal.

A support structure 128, which may be in the form of a projecting rim, shelf or lip is provided near the lower end or base of the fireplace unit 120 along the periphery to support the floor insert 122. The shelf or lip 128 may define an open area 123. Various other support structures may be used to support the insert 122. This may also include a non-removable floor that may or may not serve as a firebox floor for directly supporting a combustible fuel source on occasions when the insert 122 is not used.

The insert 122 facilitates cleaning and maintenance of the fireplace unit. The floor insert 122 retains and supports the combustible fuel when positioned within the interior 14 of the fireplace unit 120. It may then be removed from the interior along with the coals, ashes, embers, etc. supported thereon so that they can be disposed of. This eliminates the need for scooping and sweeping any ashes or other materials directly from the fireplace interior 14.

The fireplace unit 120 is shown as a portable, free-standing unit and is provided with a set or pair of wheels 130 at its base to facilitate moving and transporting the unit 120. The wheels 130 are shown located on either side of the forward face at the corners, although they could be located at other positions. This could be along the sides and/or back of the unit, as well. A leg, foot, skid or support member 132 is shown and may be provided at the rear of the base to maintain keeping the unit level or horizontal when it is supported by the wheels 130.

A handle 134 is mounted to the sidewalls 24, 26 at the rear of the unit to facilitate grasping and maneuvering the fireplace unit 120. The handle 134 could be located at different positions as well, such as the front of the unit. The wheels 130 may also be provided along the sidewalls 24 or 26, such as at a forward corner and back corner, with the handle 134 being located on the same or opposite side from the wheels 130.

The fireplace unit 120 is provided with a cylindrical flue 136. In this embodiment, the upper throat 20 terminates and is provided with a triangular upper throat plate or member 138 having a central circular opening 140 to facilitate coupling and mounting of the cylindrical flue 136 for allowing communication of the flue with the smoke chamber and interior of the fireplace unit. In other embodiments, the upper throat 120 may be shaped and configured to gradually contour from the triangular shape of the upper throat to the cylindrical shape of the flue 136, eliminating the need for the throat plate 138.

A movable damper 142 is also provided with the fireplace unit 120. The damper 140 is shown located within the flue 136, although the damper in this and other embodiments may be located at or near the upper throat 120 or other positions. Because of the constricted nature of the throat and/or flue, the damper 142 may be smaller than those used for conventional fireplaces. The damper 142 is movable between open and closed positions to open and close the flue and/or throat. A handle 144 that may be grasped from the exterior of the unit 120 is provided for selectively moving the damper 142 between the open and closed positions. The handle 144 or other device may also provide an indication of whether the damper 142 is in the open or closed positions. If necessary, various securing mechanisms may be used for maintaining the damper 142 in the open, closed or intermittent positions. These may include magnets, clips, weights or counter-weights, ratchets, detents, friction, etc. The damper 142 controls air and gas flow through the flue 136 where it is discharged through flue discharge 146.

Figure 7:
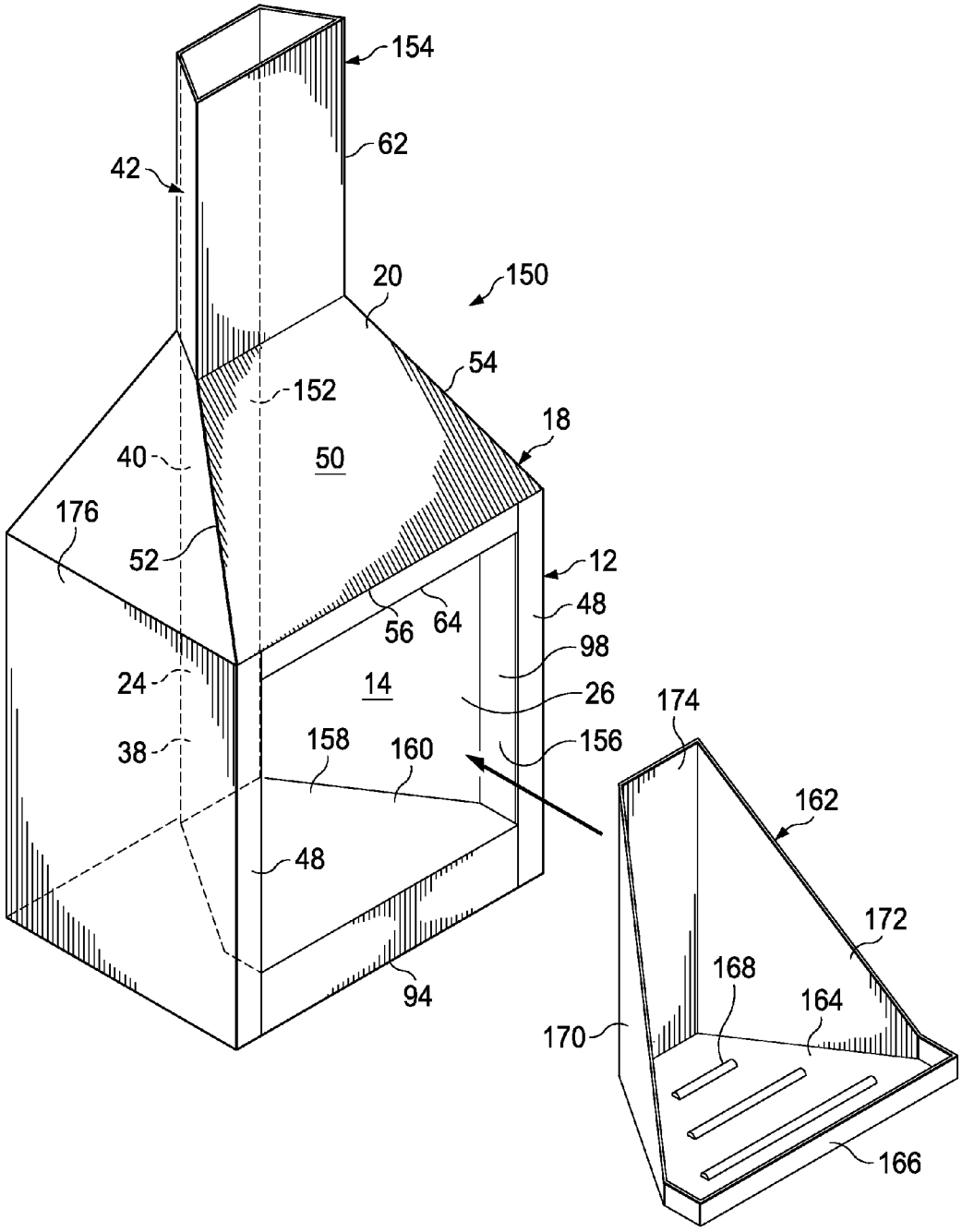
FIG. 7 is a front perspective view of still another embodiment of a fireplace unit incorporating a housing and shown with a removable insert of the fireplace unit exploded away, and constructed in accordance with the invention.

FIG. 7 shows another embodiment of a fireplace unit 150. The fireplace unit 150 is similar to the fireplace units previously described, with similar components labeled with the same reference numerals. In the fireplace unit 150 there is no interior rear wall that forms an inner conduit or air tunnel or vented lower chamber, such as the chamber 92 previously described. Instead of the converging sidewalls 24, 26 converging to a vertex. The converging sidewalls 24, 26 terminate at and are joined together along their rearward ends by a rear wall 152 that forms the back or rear of the interior compartment 14. The rear wall 152 and sidewalls 24, 26 may all be formed from the same piece of material that has been bent, formed, molded or otherwise shaped to form the various walls. In other embodiments, the walls may each be formed separately in one more portions that are coupled together. The rear wall 152 extends the entire height of the unit 150, including the rear wall of the flue 154. Thus, the firebox portion, smoke chamber portion and flue portion all have a generally trapezoidal or isosceles trapezoidal transverse cross section along their heights. This rear wall 152 also has the same dimensions and relative proportions as the interior wall 86, as shown in FIG. 5, with the dimensions represented by A in FIG. 5 applying and corresponding to the rear wall 152 as well. The sidewalls 24, 26 may also have similar dimensions and relative proportions to $B_1$ and $B_2$ of FIG. 5, as described.

As is shown in FIG. 7, a short, forward projecting hearth portion 156 is provided with the fireplace unit 150 and extends forward from the forward ends of the sidewalls 24, 26. The forward hearth portion 156 may be formed from a continuation of the materials forming the sidewalls 24, 26, wherein the continuation of the sidewalls 24, 26 are substantially parallel to one another. A firebox floor 158 also is provided with an extended hearth portion 160.

A removable firebox floor insert 162 is also shown provided with the unit 150. The insert 162 is similar to the insert 122 and has a floor 164 that is generally configured to overlay the floor 158 and correspond to the interior compartment 14. The insert 162 has a short upward projecting lip or rim 166, which may be similar to the lip 126, extending around the forward portion of the floor 164 corresponding to the hearth portion 160 of the floor 158. Ridges 168 similar to the ridges 124 of the insert 122 may also be provided on the floor 164.

The insert 162 differs from the insert 122 in that extending rearward from the lip 166 are tapered upright sidewalls 170, 172 that extend along the periphery of the insert 162 rearwardly upward from the rim 166 and are joined together at their rearward ends by rear wall 174. The rear wall 174 may terminate at, below or above the firebox line 44, as shown and described with respect to FIG. 2.

The fireplace unit 150 is also provided with a cubical outer housing 176 having square, rectangular or other-shaped walls that surround sidewalls 24, 26 and extends upward to the upper throat 20 or base of the flue 154. The housing 176 may be formed from plate material, such as metal plate, that may be the same or different from those forming the other components of the unit 150, or may be formed from brick, masonry or other materials. The materials of the housing or portions thereof may be thermally conductive to facilitate heat transfer from the unit 15, or may non-thermally conductive. The housing 176 may be configured and provide the fireplace unit 150 with a more conventional look that is similar to conventional fireplaces. The housing 176 or portions thereof may have other non-cubical shapes and configurations as well. For instance, the housing 176 may be cylindrical, conical, spherical, etc.

In other embodiments, a housing that may surround the sidewalls, flue or other components of the unit may be in the form of a rigid or non-rigid or flexible structures, that may be wrapped or draped, built or otherwise provided or formed around the unit components.

Figure 8:
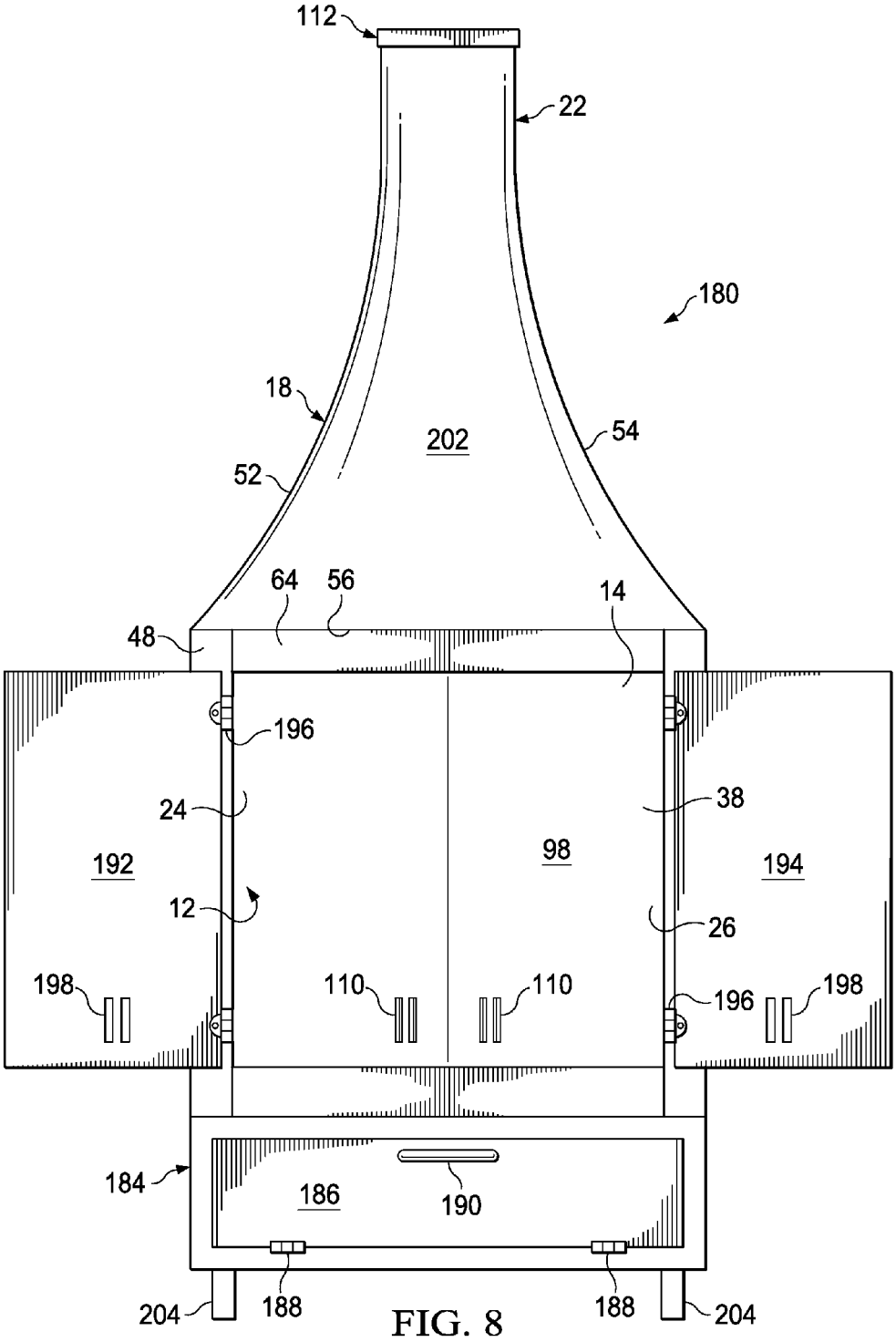
FIG. 8 is a front elevational view of a further embodiment of a fireplace unit employing doors and having a contoured smoke chamber or throat, and constructed in accordance with the invention.
Figure 9:
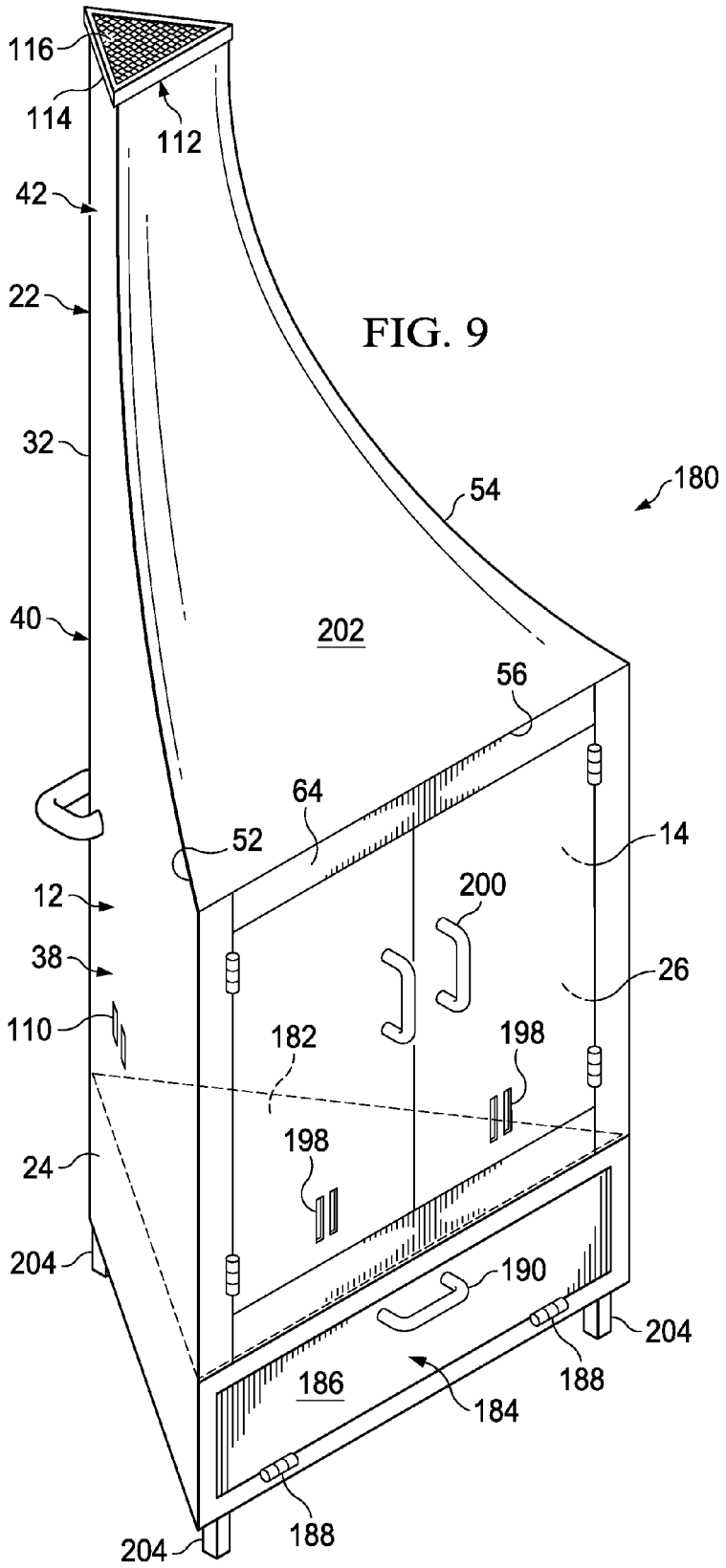
FIG. 9 is a front perspective view of the fireplace unit of FIG. 8.

Referring to FIGS. 8 and 9, another embodiment of a fireplace unit 180 is shown. The fireplace unit 180 is similar to those previously described, with similar components labeled with the same reference numerals. In the fireplace unit 180, the firebox floor 182 is raised or elevated. The firebox floor 182 may be provided at an elevated position by a variety of different methods. This may include providing an elevated base or rigid or collapsible legs. An apron of various sizes and designs may also be attached to the base. Such added elements may include wheels, skids or fixed or movable feet.

In the embodiment shown, an enclosed storage area 184 is provided under the elevated floor 182. The walls of the storage area 184 may be formed by a lower extending continuation of materials forming the converging sidewalls 24, 26. In other embodiments different members or panels may be used to form the walls of the storage area 184.

A front panel 186 is provided at the forward end of the storage area 184 to close off a forward opening of the storage area 184. The panel 186 constitutes a door that may be removable, movably or pivotally mounted, such as by hinges 188, to the unit to facilitate opening and closing the forward opening of the storage area 184. A handle 190 may be provided on the panel 186 to facilitate such opening and closing.

The storage area 184 provides a convenient means for storing tools, utensils, and other equipment and items that may be used or that are associated with the fireplace unit 180. The storage area 184 may also be used to store fuel, such as a canister or container of combustible gas or other fuel, which may be used with the unit 180. Such canister or container (not shown) may be coupled to a burner located within the interior compartment 14 of the unit 180 while being housed within the storage area 184.

A set of doors 192, 194 are provided for selectively closing the forward opening of the fireplace unit 180. The doors 192, 194 are mounted to the sides of the forward face of the fireplace unit 180 along the door's outer edges by hinges 196. The doors may be solid materials in the form of panels, and be provided with vents 198 to allow ambient air to flow into the interior 14 through the vents 198 when the doors 192, 194 are closed. In certain embodiments, the doors 192, 194 may be formed from tempered glass or other fire or heat resistant material that is transparent or translucent so that the fire and flames within the interior 14 may be viewed from the exterior. The doors 192, 194 may be provided with handles 200 (FIG. 9) to facilitate opening and closing the doors 192. A latch mechanism (not shown) may also be provided to retain the doors 192, 194 in the closes and/or open positions.

In other embodiments, the doors 192, 194 may constitute framed wire mesh or screen materials that allow air flow therethrough, while preventing sparks and embers from escaping from the interior. In still other embodiments, the doors 192, 194 may be eliminated and a retractable or movable screen or mesh curtains may hang from the header 64 or other structures provided around the upper forward face or face frame of the fireplace unit 180.

The fireplace unit 180 also includes a throat cover 202 that is in an arcuate configuration. As shown, the throat cover 202 curves upward from the forward end 56 toward the upper throat 20 and is smoothly contoured and merges smoothly with the forward wall 62 of the flue 202 in a concave arcuate configuration, as viewed from the exterior. The throat cover 202 and forward wall 62 of the flue may all be formed from a single piece or sheet of material that has been shaped, molded or otherwise configured to provide the smooth curved shape. This provides a smooth air flow from the smoke chamber to the flue without any projecting angles, ledges or other structures within the interior between the smoke chamber and the flue 202.

The unit 180 is also provided with a set of legs 204 at its corners, for elevating the unit 180. The legs 204 may be a variety of heights to facilitate providing the firebox interior 14 or firebox floor at a selected height. The legs 204 or other support members may be positioned at different positions. An elevated base may also be provided in lieu of legs or support members.

Figure 10:
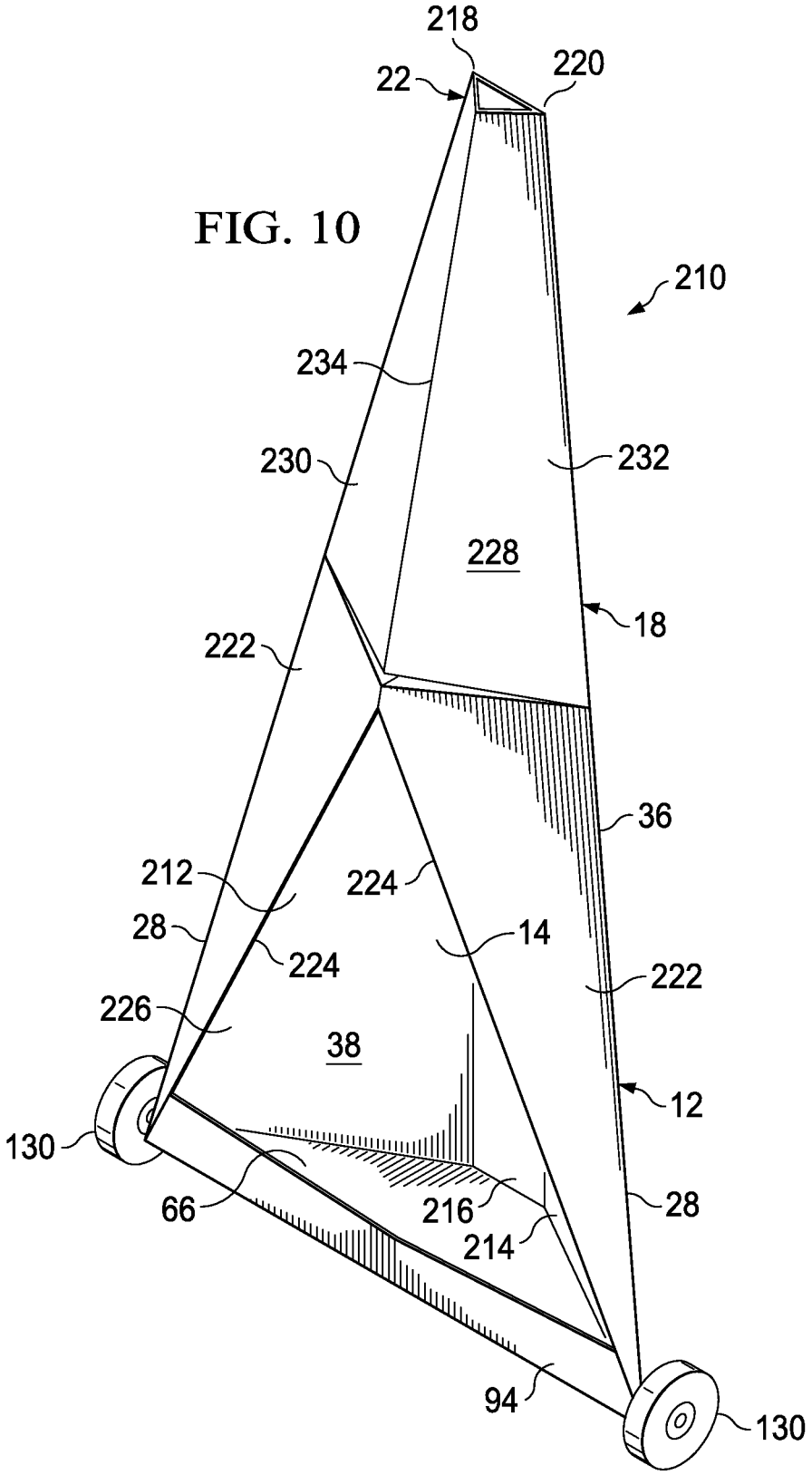
FIG. 10 is a front perspective view of an alternate embodiment of a fireplace unit having a tapered configuration and constructed in accordance with the invention.

FIG. 10 shows still another embodiment of a fireplace unit 210. The fireplace unit 210 is similar to the fireplace units previously described, with similar components labeled with the same reference numerals. The unit 210 employs converging sidewalls 212, 214, similar to the sidewalls 24, 26, however, the forward and upper ends of the sidewalls 214, 216 are one and the same. The sidewalls 212, 214 converge and terminate and are joined at their rearward ends by a rear wall 216, which is similar to the rear wall 152 (FIG. 7) of the unit 150. The forward ends 28 of the sidewalls 212, 214 taper or slope rearwards from the front lower ends to the uppermost corners 218, 220 of the rear wall 216. A shroud portion 222 extends from the lower forward corner of each sidewall 24, 26, gradually projecting forward, as necessary so that the forward edge 224 of each shroud 222 generally lie in the same plane and intersects with the forward edge of the other shroud in a peak or vertex. This plane forms a front or forward triangular opening 226 of the fireplace unit, and may be oriented vertically, substantially vertically or be inclined. The lower lip 96 or forward edge of the fireplace unit may also lie in this plane.

A combination throat cover and flue wall 228 extends upward from the intersecting shrouds 222. The throat cover/flue wall 228 may be formed as two panels 230, 232, which may be formed from the same piece or different pieces of material. The panels 230, 232 are trapezoidal in shape and are joined along their rearward ends to the forward end or edge of the sidewalls 212, 214, respectively. The panels 230, 232 converge at their forward ends where they are joined together to form a vertex 234. The upper rear corners of the panels 230, 232 merge or meet with the corners 218, 220 of the rear wall 216. The upper ends of the panels 230, 232 and rear wall 216 may be flat and all lie in the same plane so that the upper ends serve as a flue discharge or outlet, which is shown configured as a triangle. In this embodiment the smoke chamber and flue are essentially integrated with the smoke chamber formed by the throat cover 228 gradually constricting and functioning as a flue.

Figure 11:
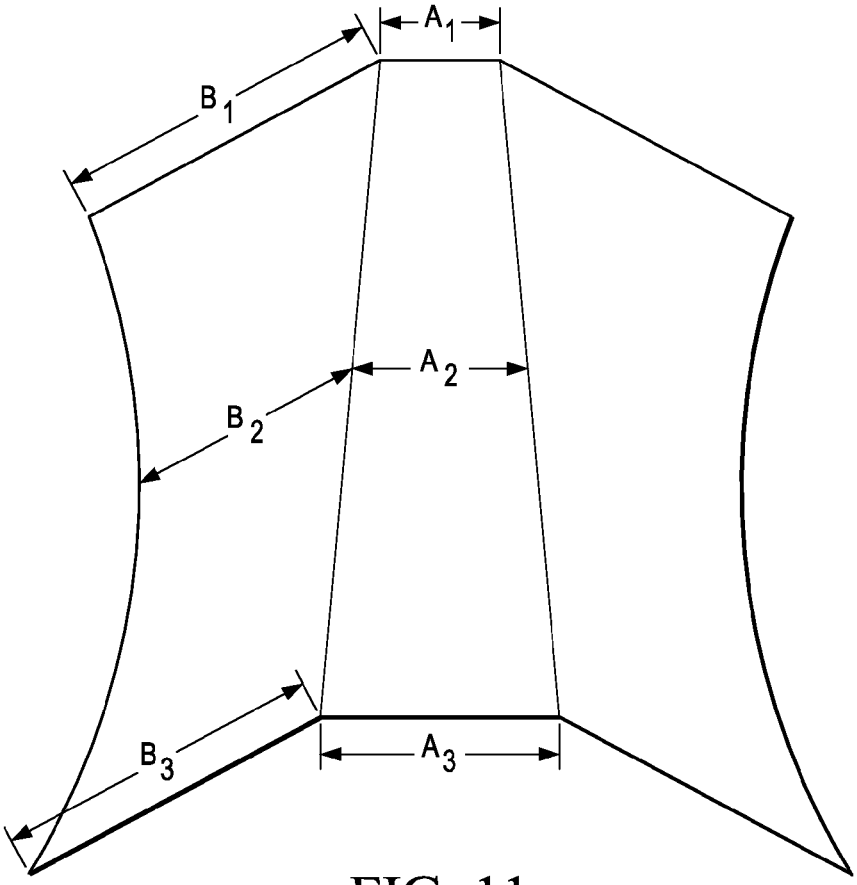
FIG. 11 is a front perspective view of sidewalls and a rear wall of a fireplace unit having variable widths along their lengths.

FIG. 11 schematically illustrates sidewalls and a rear wall of a fireplace unit that may have varying widths along their heights or lengths. As is shown, the sidewalls and rear wall may still have the same dimensions and relative proportions at any point along their heights or lengths to those illustrated in FIG. 5 and described previously, wherein $A_1$ is compared to $B_1$, $A_2$ is compared to $B_2$, $A_3$ is compared to $B_3$, etc. Such relationship is true for all or a majority portion of the rear wall's length or height, as has been previously described with respect to FIG. 5.

Figure 12:
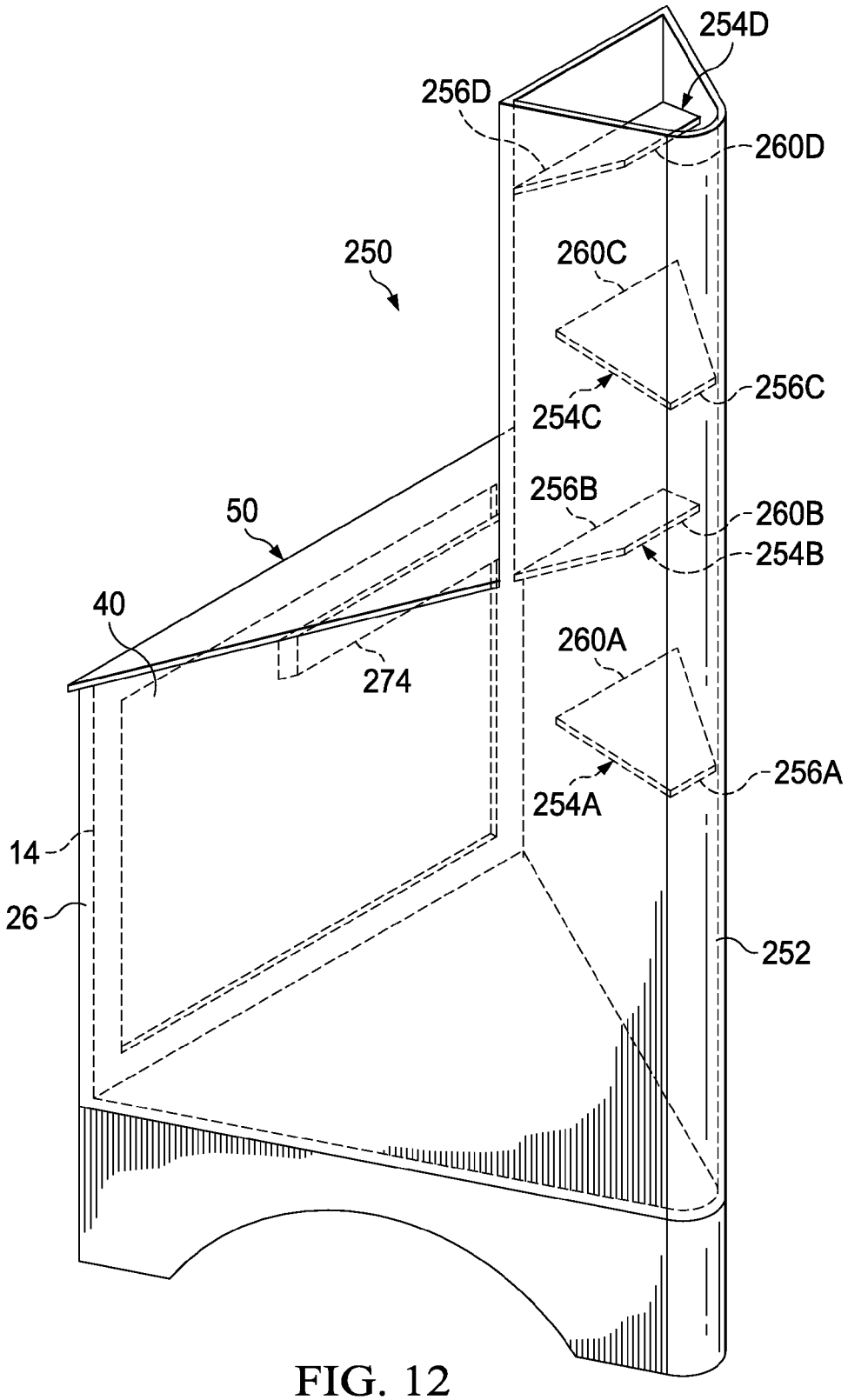
FIG. 12 is a side perspective view of an alternate embodiment of a fireplace unit employing smoke diversion bodies, and configured in accordance with the invention.

Referring to FIG. 12, another embodiment of a fireplace unit 250 is shown. The fireplace unit 250 is similar to the fireplace units previously described, with similar components labeled with the same reference numerals. The fireplace unit 250 may be provided without the air conduit 88. In the fireplace unit 250, the sidewalls 24, 26 are joined at their rearward ends to a curved or arcuate rear wall 252. This arcuate rear wall 252 may be formed, for example, when the sidewall members 24, 26 are formed from a single piece of material that is bent or angled so that the vertex portion where the material is bent forms the curved wall 252.

The fireplace unit 250 is also provided with several smoke diversion bodies 254A-254D. The smoke diversion bodies 254A-254D may each be formed as a generally flat planar member having flat, planar upper and lower surfaces, although they may have other shapes and configurations as well. In certain embodiments, the smoke diversion bodies 254A-254D may be formed from materials having a thermal conductivity (k) of 10 W/m·° C. or more at 25° C.

Figure 13:
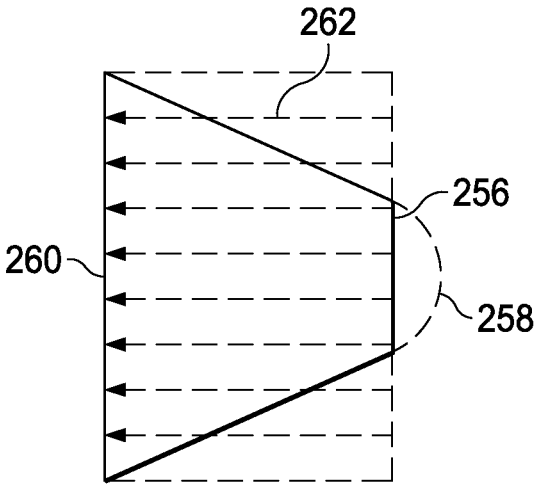
FIG. 13 is a top plan view of a smoke diversion body employed in the fireplace unit of FIG. 12.

As shown in FIG. 13, the smoke diversion body 254A constitutes the lowermost smoke diversion body 254 and has a base end 256A that locates at or adjacent the rearward ends 30 of the sidewalls 24, 26 and may be joined thereto. The base end 256A may also have a curved portion or extension 258, as designated by the dashed line, for projecting into the recess formed by the curved rear wall 252. Alternatively, the curved portion 258 may be eliminated so that an opening is formed at the base end of the smoke diversion body 254A to allow materials, such as water, condensate, soot, etc., to pass between the base end 256 and the rear wall 252. Other openings for such material passage may also be provided near or at the base end 256A, such as may be formed by the base end 256A being located slightly forward of the rear ends 30 of the sidewalls 24, 26.

Figure 14:
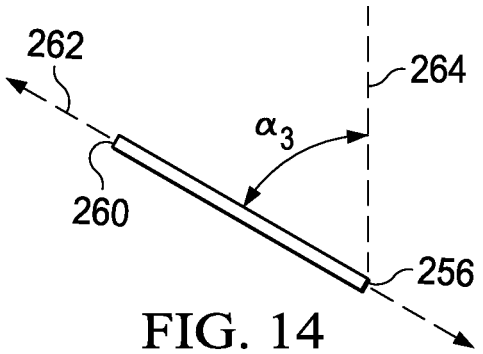
FIG. 14 is a side plan view of the smoke diversion body of FIG. 13.

When mounted in the unit 250, the smoke diversion body 254A has an opposite projecting end 260 that is spaced apart and projects forward from the base end 256A, with the smoke diversion body 254A extending transversely between the sidewalls 24, 26. The side edges of the body 254A be joined or coupled to the sidewalls 24, 26. The smoke diversion body 254A is configured and oriented so that a line or lines of projection 262, which are shown in FIG. 13 being spaced across the width of the smoke diversion body 254A, extend between the base end 256A and projecting end 260 at an angle $\alpha_3$, as measured from a vertical axis 264 (FIG. 14) extending through and above the base end 256A. The angle $\alpha_3$ may range from 1° to as much as 90° but may be no greater than 90° to avoid downward deflection of smoke and gases. In other more specific embodiments the angle $\alpha_3$ may range from 20° to 80°, from 25° to 75°, from 30° to 60°, from 35° to 55°, and from 40° to 50°. In a specific embodiment, the angle $\alpha_3$ may be approximately 45°. The angle $\alpha_3$ for the smoke diversion bodies 254B to 254D may also be the same as that described for smoke diversion body 254A when they are mounted in the unit 250. In many embodiments where the smoke diversion bodies are planar or have a planar lower surface, the angle $\alpha_3$ constitutes the angle of the plane of the lower surface of the smoke diversion body 254.

Figure 15:
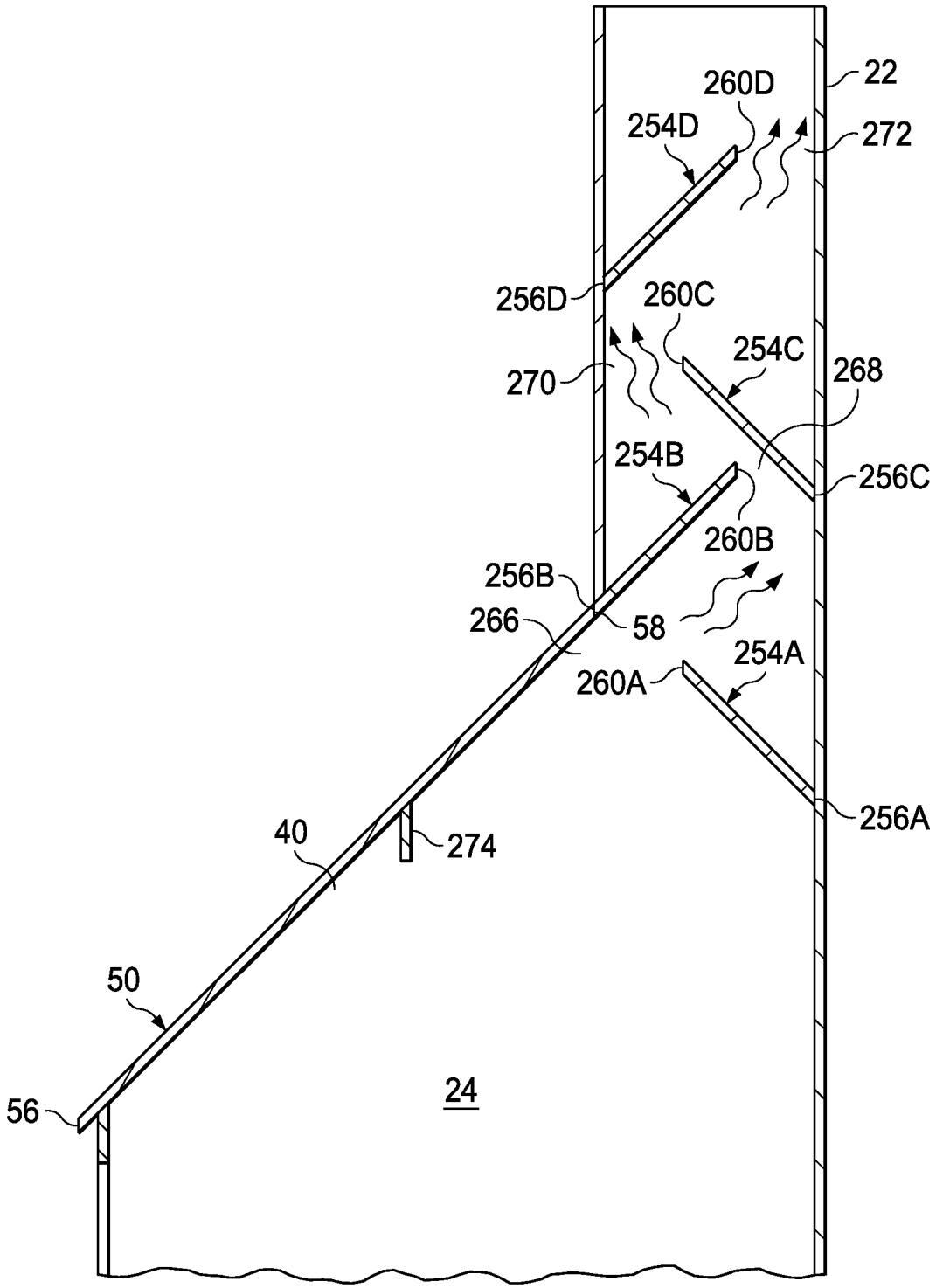
FIG. 15 is a cross-sectional side view of the fireplace unit of FIG. 12.

The smoke diversion body 254A oriented at the angle $\alpha_3$ projects into the smoke chamber, as defined by the smoke chamber portion 40, so that the smoke diversion body 254A forms an angled or narrowing constriction of smoke flow area 266 (FIG. 15) in the smoke chamber 40. As can be seen in FIG. 15, this facilitates constriction of a smoke flow area within the smoke chamber by 50% or more at its narrowest constriction as designated at 266. The area constriction 266 provided by the smoke diversion body 254A will typically be equal to or greater than that defined by the transverse area of the interior of the flue 22 where it meets the sloped throat cover 50. As described herein, the smoke flow area constrictions as defined by the smoke diversion bodies are those as measured along the lines of projection 262, relative to the smoke flow area without the presence of the smoke diversion body 254. In other embodiments, the smoke diversion bodies 254 may provide a smoke flow area constriction of 55%, 60%, 65%, 70%, 75%, 85%, or 90%.

The other smoke diversion bodies 254B-254D may have similar configurations to those of the smoke diversion body 254A, as described, and operate in a similar manner. Referring to FIG. 15, the smoke diversion body 254B has a base end 256B that is located at or adjacent to the sloping throat cover 50, with the projecting end 260B projecting rearwardly into the interior of the flue 22 defining a smoke flow constricting area 268.

The smoke diversion body 254C has a base end 256C that is located at or adjacent to flue wall at the rear of the flue 22 with the projecting end 260C projecting forward into the interior of the flue 22. The base end 256C of the smoke diversion body 254C is shown located at a position below the projecting end 260B of the smoke diversion body 254B to illustrate one possible configuration where multiple smoke diversion bodies 254 are employed where some or all of the smoke diversion bodies 254 are in an overlapping configuration. The smoke diversion body 254 C defines a smoke flow area constriction 270.

The uppermost smoke diversion body 254D has a base end 256D that is located at or adjacent to the flue wall at the front of the flue 22, with the projecting end 260D projecting rearwardly. The base end 256D of the smoke diversion body 254D is shown located at a position above the projecting end 260C of the smoke diversion body 254C to illustrate another possible configuration where multiple smoke diversion bodies 254 are employed where some or all of the smoke diversion bodies 254 are in a non-overlapping configuration. The smoke diversion body 254D defines a smoke flow area constriction 272.

In the embodiment shown, each successive smoke diversion body 254A to 254D may provide a progressively smaller or narrowing smoke flow area constriction. Thus, constriction 266 is larger than constriction 268, which in turn is larger than constriction 270, which in turn is larger than constriction 272, etc.

The smoke diversion bodies 254 direct the confluence of heat and smoke from the hearth fire located in the fireplace unit 250 interior at the rear of the unit 250. The smoke diversion bodies 254 divert and force this heat and smoke upward through the flue 22. As the fire below heats the smoke diversion bodies and the smoke and other particulates are diverted around the smoke diversion bodies 254, it creates an environment where further combustion takes place (i.e. secondary combustion), resulting in reduced smoke and particulates being discharged from the unit 250.

As can be appreciated, the smoke diversion bodies may be located on the same side or opposite sides in a staggered, overlapping or non-overlapping configuration.

A smoke stop body 274 may also be provided in some embodiments, as shown in FIG. 15. The smoke stop body 274 may consist of a planar member or other configured member that extends across the width of the unit 250 between the side walls 22, 24 and projects downward from the sloped throat cover 50. The smoke stop body 274 facilitates prevention of smoke from rolling or passing down the interior of the throat cover 50 and out of the interior compartment 14.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A fireplace unit comprising:

a pair of spaced apart opposite, upright sidewalls, the sidewalls defining an interior compartment that forms a combustion chamber of the fireplace unit wherein the sidewalls are directly exposed to the combustion chamber, the sidewalls each having a forward end and a rearward end substantially aligned along lines that converge rearwardly, the sidewalls being joined together at the rearward ends so that the joined sidewalls have a substantially triangular transverse cross-sectional configuration, the upper end of each of the sidewall sloping upward from the forward end toward the rearward end;

a floor that extends between the sidewalls for closing the lower end of the interior compartment;

a sloping cover that is coupled to the upper ends of the sidewalls for closing the upper end of the interior compartment, the cover terminating at a position forward of the rearward ends of the sidewalls, the area beneath the sloping cover defining a smoke chamber;

a flue having a flue wall that extends upward from the sloping cover, the flue wall defining a flue interior and having a lower opening for directing smoke and air upward through the flue interior from the interior compartment and smoke chamber; and a first smoke diversion body that extends between the sidewalls, the smoke diversion body having a base end located at or adjacent to the rearward ends of the sidewalls and an opposite projecting end that projects away from the base end and into the smoke chamber so that the smoke diversion body forms a constriction of a smoke flow area of the smoke chamber, the smoke diversion body being oriented so that lines of projection extending between the base end and projecting end are located at an angle of from 1° to 90° from a vertical axis extending through and above the base end of the smoke diversion body, and wherein an opening is formed at the base end of the first smoke diversion body to allow materials to pass therethrough.

2. The fireplace unit of claim 1, wherein:

there is at least one other smoke diversion body positioned above the first smoke diversion body that has a base end located at or adjacent to at least one of the sloping cover, flue wall or rearward ends of the sidewalls and an opposite projecting end that projects into at least one of the smoke chamber and flue interior, the at least on other smoke diversion body being oriented so that lines of projection of the smoke diversion body extending between the base end and projecting end of the at least one other smoke diversion body are at an angle of from 1° to 90° from a vertical axis extending through and above the base end of the at least one other smoke diversion body.

3. The fireplace unit of claim 1, wherein:

the sidewalls are formed from a single piece of material.

4. The fireplace unit of claim 1, wherein:

the sidewalls are formed from metal plate materials.

5. The fireplace unit of claim 1, wherein:

the lines of projection extending between the base end and projecting end are located at an angle of from 25° to 75° from a vertical axis extending through and above the base end.

6. The fireplace unit of claim 1, wherein:

the smoke diversion body facilitates constriction of a smoke flow area within the smoke chamber by 50% or more as measured along the lines of projection relative to the smoke flow area without the smoke diversion body.

7. The fireplace unit of claim 1, wherein:

at least one of the sidewalls is vented to allow airflow through the sidewall into the interior compartment.

8. The fireplace unit of claim 1, wherein:

the floor is a removable floor.

9. The fireplace unit of claim 1, further comprising:

face frame side members that are coupled to the forward ends of the sidewalls.

10. The fireplace unit of claim 1, wherein:

the sidewalls are planar and converge toward the rearward ends about a substantially vertical axis.

11. The fireplace unit of claim 1, wherein:

the smoke diversion body has a thermal conductivity (k) of 10 W/m·° C. or more at 25° C.

12. The fireplace unit of claim 1, wherein:

the smoke diversion body has a generally planar lower surface.

13. A fireplace unit comprising:

a pair of spaced apart opposite, upright sidewalls, the sidewalls defining an interior compartment that forms a combustion chamber of the fireplace unit wherein the sidewalls are directly exposed to the combustion chamber, the sidewalls each having a forward end and a rearward end substantially aligned along lines that converge rearwardly, the sidewalls being joined together at the rearward ends so that the joined sidewalls have a substantially triangular transverse cross-sectional configuration, the upper end of each of the sidewall sloping upward from the forward end toward the rearward end;

a floor that extends between the sidewalls for closing the lower end of the interior compartment;

a sloping cover that is coupled to the upper ends of the sidewalls for closing the upper end of the interior compartment, the cover terminating at a position forward of the rearward ends of the sidewalls, the area beneath the sloping cover defining a smoke chamber;

a flue having a flue wall that extends upward from the sloping cover, the flue wall defining a flue interior and having a lower opening for directing smoke and air upward through the flue interior from the interior compartment and smoke chamber; and a first smoke diversion body has a thermal conductivity (k) of 10 W/m·° C. or more at 25° C. that extends between the sidewalls, the smoke diversion body having a base end located at or adjacent to the rearward ends of the sidewalls and an opposite projecting end that projects away from the base end and into the smoke chamber so that the smoke diversion body forms a constriction of a smoke flow area of the smoke chamber, the smoke diversion body being oriented so that lines of projection extending between the base end and projecting end are located at an angle of from 1° to 90° from a vertical axis extending through and above the base end of the smoke diversion body, the smoke diversion body having a generally planar lower surface, the smoke diversion body facilitating constriction of a smoke flow area within the smoke chamber by 50% or more as measured along the lines of projection relative to the smoke flow area without the smoke diversion body, and wherein an opening is formed at the base end of the smoke diversion body to allow materials to pass therethrough.

14. The fireplace unit of claim 13, wherein:

there is at least one other smoke diversion body positioned above the first smoke diversion body that has a base end located at or adjacent to at least one of the sloping cover, flue wall or rearward ends of the sidewalls and an opposite projecting end that projects into at least one of the smoke chamber and flue interior, the at least on other smoke diversion body being oriented so that lines of projection extending between the base end and projecting end of the at least one other smoke diversion body are at an angle of from 1° to 90° from a vertical axis extending through and above the base end of the at least one other smoke diversion body.

15. The fireplace unit of claim 13, wherein:

the sidewalls are formed from a single piece of material.

16. The fireplace unit of claim 13, wherein:

at least one of the sidewalls is vented to allow airflow through the sidewall into the interior compartment.

17. The fireplace unit of claim 13, wherein:

the lines of projection extending between the base end and projecting end are located at an angle of from 25° to 75° from a vertical axis extending through and above the base end.

18. The fireplace unit of claim 13, wherein:

the floor is a removable floor.

19. The fireplace unit of claim 13, wherein:

face frame side members that are coupled to the forward ends of the sidewalls.

20. The fireplace unit of claim 13, further comprising:

the sidewalls are planar and converge toward the rearward ends about a substantially vertical axis.

* * * * *